US006991589B1

(12) United States Patent
Patterson

(10) Patent No.: US 6,991,589 B1
(45) Date of Patent: Jan. 31, 2006

(54) MULTI-PLANAR ROWING MACHINE AND ASSOCIATED EXERCISE PROTOCOLS

(76) Inventor: Paul Patterson, 87 Ch. Pic Bois, Val Des Monts, Quebec (CA) J8N 6C4

( * ) Notice: Subject to any disclaimer, the term of this patent is extended or adjusted under 35 U.S.C. 154(b) by 368 days.

(21) Appl. No.: 09/925,934

(22) Filed: Aug. 9, 2001

Related U.S. Application Data

(60) Provisional application No. 60/223,931, filed on Aug. 9, 2000.

(51) Int. Cl.
*A63B 69/06* (2006.01)
*A63B 71/00* (2006.01)

(52) U.S. Cl. ..... 482/72; 482/142

(58) Field of Classification Search ..... 482/72, 482/142, 95–96; 472/106–115
See application file for complete search history.

(56) References Cited

U.S. PATENT DOCUMENTS 1,398,166 A * 11/1921 Winchel ..... 472/4
4,408,105 A * 10/1983 Tanaka ..... 200/437
4,996,731 A * 3/1991 Kruyt ..... 5/618
5,050,589 A * 9/1991 Engle ..... 601/26
5,125,884 A * 6/1992 Weber et al. ..... 482/145
5,447,474 A * 9/1995 Chang ..... 472/113
5,681,250 A * 10/1997 Hoover et al. ..... 482/142
5,840,001 A * 11/1998 Schedel ..... 482/142
5,902,220 A * 5/1999 Lin ..... 482/142
6,394,938 B1 * 5/2002 Tornabene ..... 482/142
6,551,219 B1 * 4/2003 Brown ..... 482/57

* cited by examiner

*Primary Examiner*—Jerome W. Donnelly
*Assistant Examiner*—Fenn C. Mathew
(74) *Attorney, Agent, or Firm*—Conley Rose, P.C.

(57) ABSTRACT

Novel multi-planar rowing machine apparatus as well as exercise methods and protocols to enhance the ability of a rowing machine to provide a full body workout. The rowing machine apparatus of the present invention allows for the rowing motion to occur in multiple planes or stroke axes. The exercise protocols of the present invention provide efficient methods for using the rowing apparatus in decline and incline positions to maximize fitness gains. The apparatus and protocols of the present invention combine gravity and isokinetic resistance to provide full exercise spectrum including strength, muscle mass, and energy system stimulus to major body flexors and extensors. The two-phase resistance provided creates maximum calorie burn per unit of exercise time, and further results in a strength balance in virtually every major leg, arm, and body core extensor and flexor.

26 Claims, 25 Drawing Sheets

MULTI-PLANAR ROWING MACHINE AND ASSOCIATED EXERCISE PROTOCOLS

CROSS REFERENCE TO RELATED PROVISIONAL APPLICATION

This invention claims priority from U.S. provisional patent application Ser. No. 60/223,931 filed Aug. 9, 2000.

BACKGROUND OF THE INVENTION

1. Field of the Invention

The invention relates to the operation of a rowing machine in multiple inclined and declined planes such that the stroke axis of the rowing machine is multi-planar. In particular, the invention relates to multi-planar rowing machine apparatus, support structure for converting a standard horizontal rowing machine into a multi-planar rowing machine, and exercise protocols for use in conjunction with a multi-planar rowing machine selectively positioned in either inclined or declined stroke axis planes.

2. Background

The sedentary lifestyle of modern men and women and corresponding injuries associated with such lifestyles are among the reasons motivating widespread interest in exercise machines. However, the rapid proliferation of exercise machines, many of varied design, have complicated the task of identifying a machine which, when used in conjunction with an appropriate exercise protocol, will enable the efficient acquisition and maintenance of strength, flexibility and energy system fitness. Among the more common exercise machines are stationary bicycles, step machines, and treadmills. All of these can be characterized as "2-limb" exercise machines in that they primarily work the legs of the user. Accordingly, none of these exercise machines are suitable for those seeking full body workouts.

The rowing machine is a "4-limb" exercise machine and is therefore capable of providing a more complete body workout. Broadly speaking, a rowing machine operates by generating resistance to a rowing motion made by the user. Typically, rowing machines are designed such that this rowing motion occurs in the horizontal plane, generally parallel to the surface on which the rowing machine is supported. This will be referred to herein as a horizontal stroke axis. The rowing motion is comprised of two phases—an extension (or "pull") phase and a recoil (or "flex") phase performed along the stroke axis. Presumably to simulate an actual rowing motion, the pull phase is typically loaded (or resisted) while the flex phase is not. When actually rowing a boat, the pull phase is resisted by the water while the flex phase is not since the oar is out of the water.

Rowing machines have been developed with various ways to provide resistance to the rowing motion. Early versions of rowing machines employed a wheel and pulley mechanism to provide resistance to the rowing motion. Later, rowing machines employed a pair of shock absorber-like piston and cylinder mechanisms attached between the frame and respective arms thereof to generate resistance to the user's rowing motion. Additional rowing machine designs have employed an isokinetic wheel-belt resistance system arranged such that the user's pulling on a cable turns a wheel, which in turn is resisted by friction against a variably-tensioned belt.

More recent rowing machines have employed an air-fan type isokinetic system to provide resistance to the user's rowing motion. Such rowing machines typically include a seat that slides unresisted with the user's motion and a rowing handle attached via a cable to a ratchet-type gear inserted into the center of a spinning air-fan type wheel. The ratchet system enables the air-fan wheel to continue to spin via momentum in the flex phase during which the user flexes their body and shortens the cable in preparation for another pull phase. A conventional rowing machine 10 which employs an air-fan type isokinetic system may be seen in FIG. 1, described in more detail below.

By using a typical horizontal rowing machine, the user can obtain low to moderate strength and muscular fitness gains in the leg extensors, the torso extensors, the upper back, the shoulder girdle, the elbow flexors and the forearms. Most of these muscular gains are obtained during the loaded pull phase of the rowing stroke while little if any gains are obtained during the unloaded flex phase. When limited to the horizontal plane, an exercise protocol performed using a typical air-fan type isokinetic rowing machine tends to only reinforce the development of extensor strength in the lower and upper legs and in the lower and upper posterior torso. In particular, in the pull phase of the stroke, the torso extensors actively work and the shoulder girdle actively stabilizes while the upper arms extend during the pull. Conversely, in the flex phase of the stroke, only the weight of the head and torso is used to maintain exercise neutral momentum as the head/torso moves forward during the flex. Accordingly, the attendant muscular fitness gains are limited to the leg extensors (calves and quadriceps), the torso extensors (spinal erectors), the upper back (shoulder retractors), the shoulder girdle, the elbow flexors (biceps) and, by virtue of a fixed wrist isometric handle hold, the forearms. It should also be appreciated that, as the aforementioned exercise protocol for the traditional rowing machine is performed in the horizontal plane, gravity has no appreciable resistive effect during either the flex or pull phases of the stroke. Thus, in contrast with some exercise machines and protocols, gravity does not enhance the fitness effect experienced.

Thus, while the rowing machine is a 4-limb exercise machine, its ability to provide a full body workout suffers from the fact it is generally only capable of producing low to moderate gains in the extensor muscles employed during the pull phase and significantly less (or no) gains in the flexor muscles employed during the flex phase. The resultant strength imbalances created have likely contributed to the reputation of both the traditional rowing machine, and exercise protocols for the traditional rowing machine, as being a less than full-body fitness solution, not significantly better than other fitness machines such as 2-limb machines.

SUMMARY OF THE INVENTION

In accordance with the present invention, there is provided novel apparatus and methods to enhance the ability of a rowing machine to provide a full body workout. In particular, the novel rowing machine apparatus of the present invention allows for the rowing motion to occur in multiple planes or stroke axes. In addition, the novel exercise protocols and methods provide techniques for maximizing the full-body muscular fitness gains that can be realized from the multi-planar rowing machine apparatus.

The multi-planar rowing apparatus and protocols of the present invention combine gravity and isokinetic air-fan-type resistance to provide full exercise spectrum including strength, muscle mass, and energy system stimulus to major body extensors and flexors. The two-phase resistance provided creates maximum calorie burn per unit of exercise time, and further results in a strength balance in virtually every major leg, arm, and body core extensor and flexor.

DETAILED DESCRIPTION OF THE INVENTION

Figure 1:
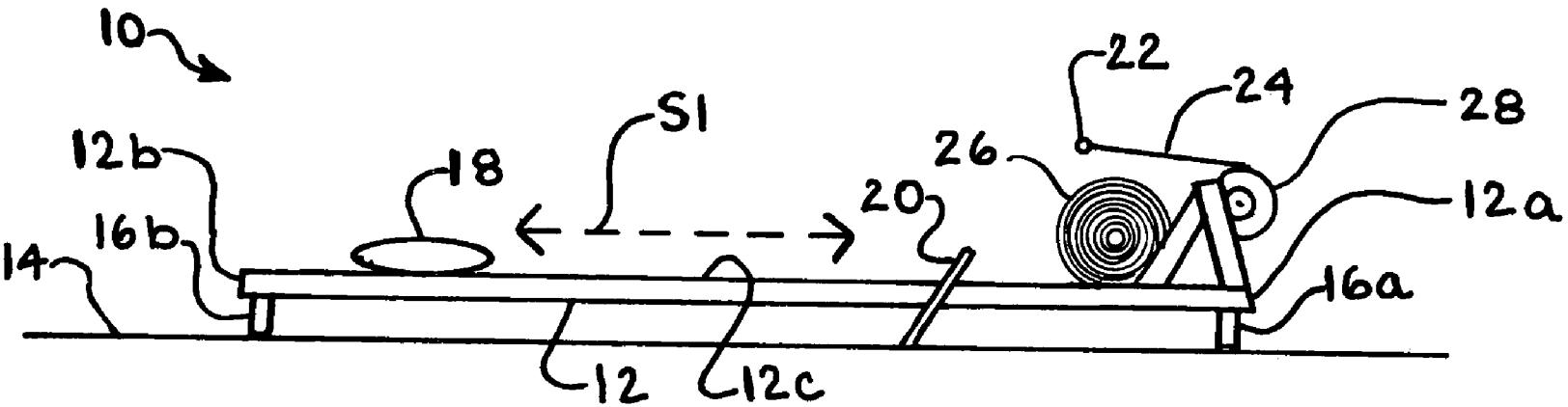
FIG. 1 is a side view of a conventional rowing machine operable in a single, horizontal, plane.

Referring now to FIG. 1, the rowing machine 10 will now be described in greater detail. As may now be seen, the rowing machine 10 includes a rail member 12 supportably mounted above a generally horizontal support surface 14, for example a floor, in a generally parallel orientation therewith. The rail member 12 is supported above the support surface 14 by front and rear support beams 16*a* and 16*b*. Each one of the front and rear support beams 16*a* and 16*b* are coupled, on one end thereof, to the rail member 12. As used herein, the terms couple or coupled, mount or mounted, attach or attached refer broadly to either direct or indirect connection. As illustrated in FIG. 1, the front and rear support beams 16*a* and 16*b* are generally orthogonal to the rail member 12. It should be noted, however, that, for many rowing machines, the support beams are at a non-orthogonal angle, for example, 45 degrees, relative to the rail member. It should be further noted that, while only one front support beam 16*a* and one back support beam 16*b* are visible in FIG. 1, a plurality of support beams may be used to enhance the support of the rail member 12 above the support surface 14. Alternatively, rather than using individual or plural support beams, many rowing machines utilize a support structure which includes one or more support struts, typically extending from the rail member, which provide additional support to the main support beams such as those illustrated in FIG. 1. Often, the support beams terminate in feet which engage the underlying support surface. Generally, the feet are used to enhance the balance of the rowing machine by increasing the surface area of the support surface engaged by the rowing machine. In some configurations, the feet may also include rollers to enhance portability of the rowing machine. Conversely, for some rowing machines, the feet are constructed of a material having a high coefficient of friction, thereby discouraging movement of the rowing machine relative to the underlying support surface.

The rowing machine 10 further includes a seat 18, a pair of foot pads 20 (only one of which is visible in FIG. 1), and a bar 22. The seat 18 is slideably attached to the rail member 12 by a sliding mechanism, hidden from view in FIG. 1, which enables the seat 18 to slide along the rail 18 along a stroke axis S1 generally parallel to the support surface 14. Typically, the sliding mechanism includes a slot longitudinally formed along an upper side surface 12*c* of the rail member 12 such that a projection (not visible) extending downwardly from a lower surface of the seat 18 may be slideably inserted therein. As will be more fully described below, when performing exercise protocols, a user seated on the seat 18 will slide towards front surface 12*a* in the flex phase of the rowing motion and towards back surface 12*b* during the pull phase of the rowing motion.

Each one of the foot pads 20 is attached on respective sides of the rail member 12. Of course, only one such foot pad 20, specifically, the right foot pad, is visible in FIG. 1. Furthermore, it should be noted that, oftentimes, the foot pads are attached to the support structure which supports a rowing machine above a surface, particularly, when the support structure is sufficiently extensive to enable any foot pads attached thereto to enjoy proper placement for use thereof. The bar 22 is grasped and pulled by a user during an exercise routine to be more fully described below. The bar 22, which is shown in an artificially elevated position in FIG. 1 to enhance the visibility thereof, is coupled to a retractable cable 24, which, in turn is coupled to an air fan wheel 26 via a pulley 28 and a ratchet gear mechanism (not shown) located within the air fan wheel 26.

A user seeking to employ the rowing machine 10 in an exercise routine would first sit on the seat 18. After placing their left and right feet on the left and right foot pads 20, respectively, and grasping the bar 22, the user would typically begin, from a start point, an exercise routine which includes at least one rowing stroke by either using their legs to push against the foot pads 20, using their arms to pull the bar 22 or both. Either of these actions produces a pulling motion which, in this example, is resisted by the air fan wheel 26. By pushing against the foot pads 20 while grasping the bar 22, the user causes the seat 18 to slide along the stroke axis S1 to produce the pull phase of the rowing motion. After reaching an end point of a stroke, the user returns to the start point in an unresisted flex phase.

Heretofore, rowing machines have been designed as single plane rowing machines configured such that the stroke axis thereof is located in a plane generally parallel to the surface on which the rowing machine apparatus is supported. In contrast, the present invention is directed to a rowing machine configured for operation in multiple planes, including planes in which the stroke axis is not generally parallel to the surface on which the rowing machine is supported. These planes include what are hereafter referred to as "declined" and "inclined" planes. When a rowing machine is operated in the declined plane, the distance separating the stroke axis from the support surface increases during the pull phase of a stroke and decreases during the flex phase thereof. Conversely, when a rowing machine is operated in the inclined plane, the distance separating the stroke axis from the support surface decreases during the pull phase of a stroke and increases during the flex phase thereof.

The present invention is further directed to certain exercise protocols which may be employed in conjunction with the selective use of a rowing machine in either the inclined or declined planes and the benefits which may be obtained through employment of these protocols. Before describing these exercise protocols, however, various support apparatus which enable a conventional rowing machine to be operated in the inclined and declined planes as well as a rowing machine uniquely configured for operation in these planes shall first be described.

Figure 2:
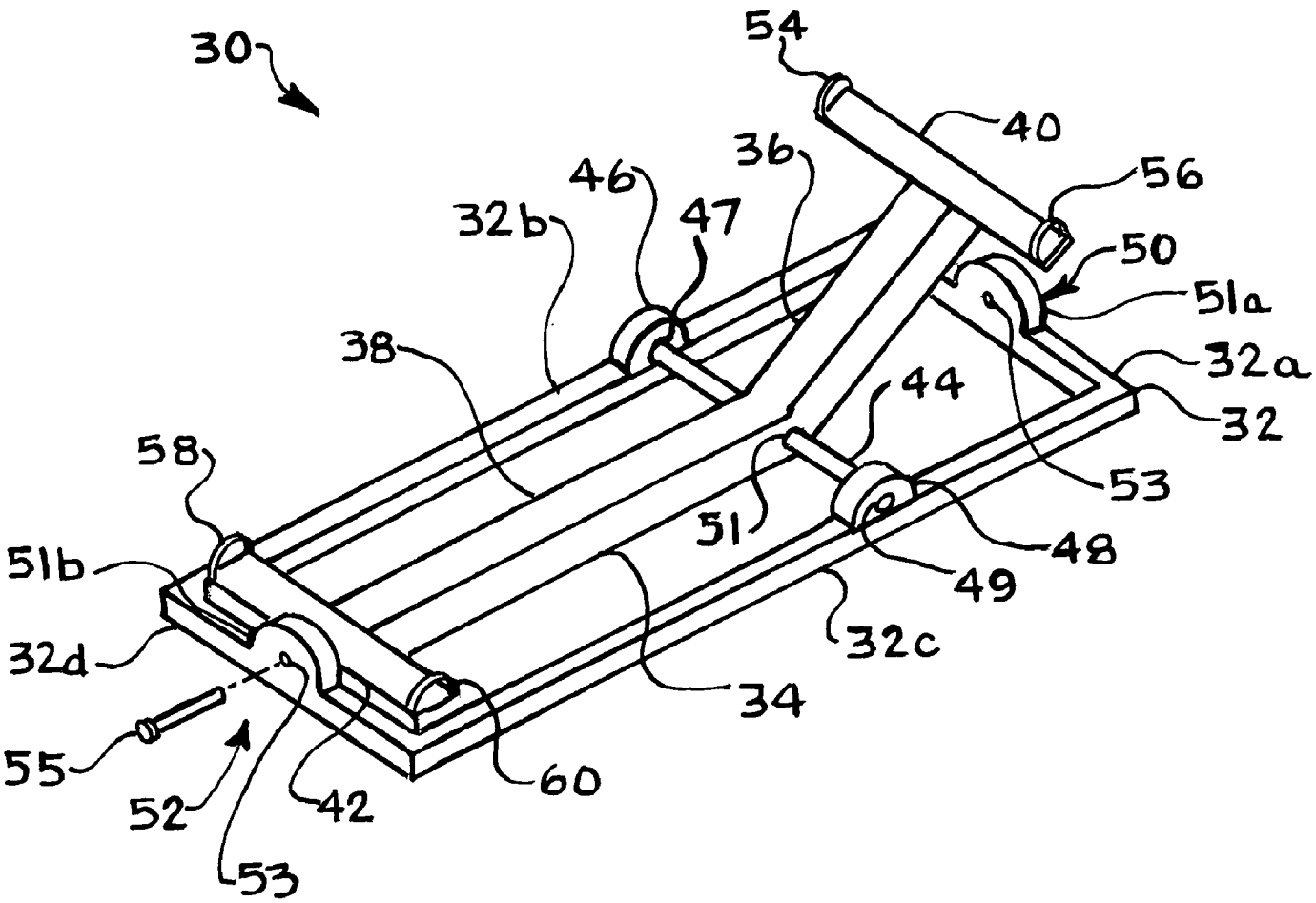
FIG. 2 is a perspective view of a support apparatus for enabling the rowing machine of FIG. 1 to be selectively operated in either an inclined or a declined position.

FIG. 2 shows a support apparatus 30 which enables a conventional rowing machine, for example, the rowing machine 10 illustrated in FIG. 1, to be selectively operated in either the inclined plane or in the declined plane. The support apparatus 30 includes a frame 32 to which a support lever 34 is pivotably mounted. Preferably, the frame 32 is constructed of metal or another strong material and has a generally rectangular shape. While the dimensions of the frame 32 may be varied, it is recommended for stability that the frame 32 be dimensioned so that the length and width are both somewhat greater than most commercially available rowing machines.

The support lever 34 includes a front portion 36 and a back portion 38 formed at an obtuse angle relative to one another. As may be seen in the drawings, the back portion 38 of the support lever 34 is longer than the front portion 36. While the ratio of the length of the back portion 38 may be varied relative to that of the front portion 36, in a preferred embodiment of the invention to be more fully described below, it is contemplated that the ratio of the length of the back portion 38 to the length of the front portion 36 should be approximately 2:1. Attached to respective ends of the support lever 34 are front and back support platforms 40 and 42. Collectively, the support lever 34 and the front and back support platforms 40 and 42 form a structure capable of supporting a rowing machine such that the stroke axis is in a plane other than the generally horizontal plane. The disclosed structure is also capable of allowing a user to change the plane of the stroke axis of a rowing machine supported thereby. Traditionally, the plane of the stroke axis of a rowing machine has always been generally parallel to the support surface on which the rowing machine was placed and since conventional wisdom has dictated that rowing machines be placed on a level horizontal support surface, the stroke axis has always been generally horizontal. Contrary to conventional wisdom, the disclosed structure enables a user to utilize a rowing machine as part of an exercise protocol which involves the stroke axis in either inclined or declined planes.

Extending orthogonally upward from each of left and right sides 32*b* and 32*c* of the frame 32 are flanges 46 and 48, each of which has a respective aperture 47 and 49 formed in the general center thereof. A first end of a securing member 44 is insertably received in the aperture 47 formed in the flange 46. From the flange 46, the securing member 44 extends through an aperture 51 formed in the support lever 34 and on to the flange 48 where a second end thereof is insertably received in the aperture 49 formed therein. In this manner, the securing member 44 both secures the support lever 34 to the frame 32 and provides an axis around which the support lever 34 may pivot between first and second positions. To minimize stress on the securing member 34 during pivoting, the securing member 44 preferably extends through the support lever 34 in the general vicinity of the juncture of the front and back portions 36 and 38 thereof. To further minimize stress on the support lever 34, a support strut (not shown) coupled, on one end, to the front portion 36 and, on the other end, to the back portion 38 may be provided.

The support apparatus 30 further includes front and back locking mechanisms 50 and 52 for respectively securing the front and back platforms 40 and 42 to front and back sides 32*a* and 32*d* of the frame 32. Of course, since the front and back portions 36 and 38 of the support lever 34 are fixed in position relative to one another, it should be clearly understood that only one of the front and back locking mechanisms 50 and 52 may be in use at any given time. For example, in FIG. 2, the rear platform 42 is locked to the frame 34 and the front platform 40 is both unlocked and elevated relative to the frame 34. Alternately, however, the front platform may be locked to the frame 34 and the back platform 42 may be both unlocked and elevated relative to the frame 34. It should be further understood that a wide variety of devices and/or structures are suitable for use as the locking mechanisms 50 and 52. For example, in the embodiment of the invention illustrated in FIG. 2, a generally orthogonal flange 51 is formed along each of the front and back sides 32*a* and 32*d*. An aperture 53 is formed in the general center of each flange 51 and a corresponding aperture (not visible) is formed in each of the front and back platforms 40 and 42. To lock a platform, for example, the back platform 42 to the frame 34, a locking pin 55 is inserted through the apertures formed in the flange 51 and the back platform 42.

In selected ones of the alternate embodiments of the invention not illustrated in the drawings, the locking mechanisms 50 and 52 may each be comprised of a strap permanently attached, on one end, to the frame 34 and securable to itself along its length after being wrapped around one of the platforms 40 or 42. In another, the locking mechanisms 50 and 52 may be comprised of locking plates, respectively attached, on one end thereof, to the front and back sides 32*a* and 32*d* and pivotable between a raised position in which the locking plates are generally orthogonal to the frame 34 and a lowered position in which the locking plates lockingly engage the front and back platforms 40 and 42, respectively.

Finally, each one of the front and back platforms 40 and 42 should include a locking mechanism to fixedly secure front and back ends of a rowing machine to the front and back platforms 40 and 42, respectively. Again, it is fully contemplated that a variety of locking mechanisms are suitable for the uses contemplated herein. For example, FIG. 2 shows a pair of straps 54 and 56, each secured on one end of the front platform 40. Each of the straps 54 and 56 may be secured around the front end of a rowing machine and secured to itself along its length to fixedly secure the front end of the rowing machine to the front platform 40. A similar pair of straps 58 and 60 may be used to secure the rear end of a rowing machine to the rear platform 42.

Figure 3A:
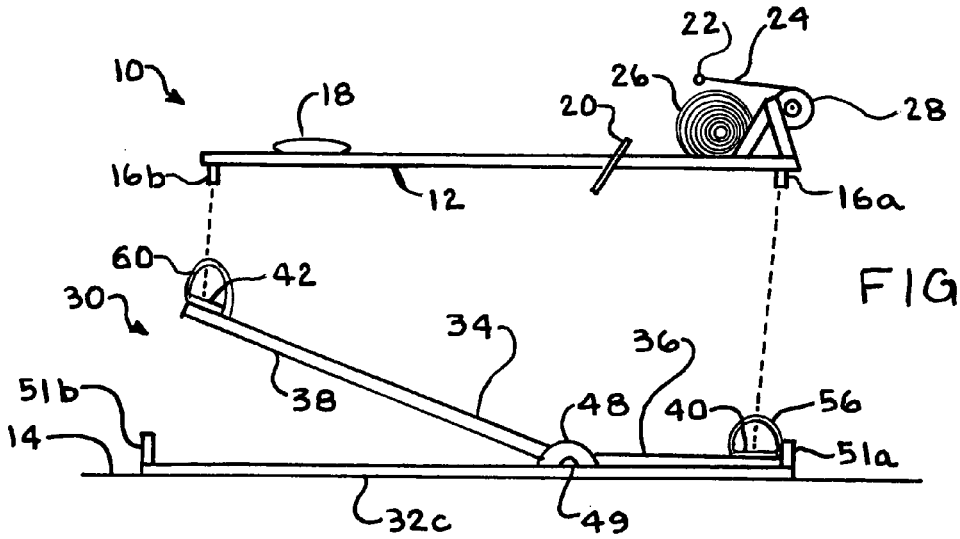
FIG. 3*a* is an exploded side view of the rowing machine of FIG. 1 prior to mounting on the support apparatus of FIG. 2.
Figure 3B:
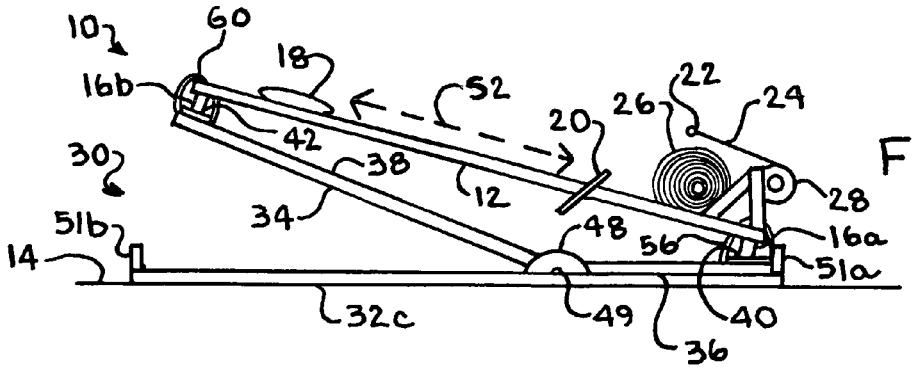
FIG. 3*b* is a side view of the rowing machine of FIG. 1 mounted on the support apparatus of FIG. 2 such that operation of the rowing machine in the declined position is enabled.
Figure 3C:
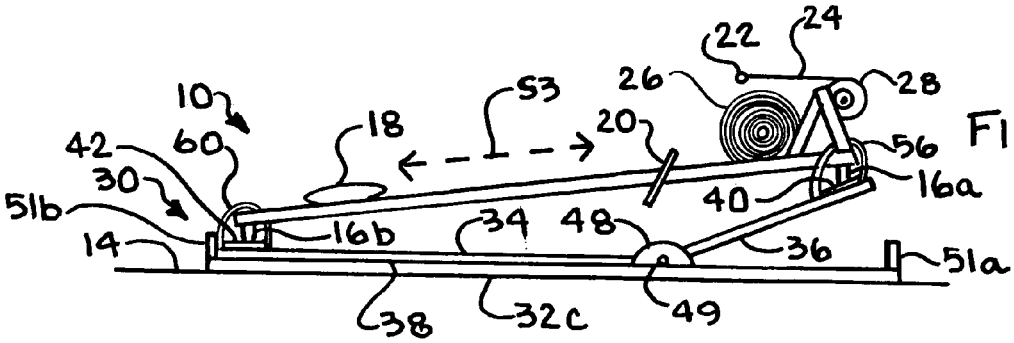
FIG. 3*c* is a side view of the rowing machine of FIG. 2 mounted on the support apparatus of FIG. 2 such that operation of the rowing machine in the inclined position is enabled.

Referring next to FIGS. 3*a*–3*c*, the manner in which the support apparatus 30 may be used to selectively enable the rowing machine 10 to operate in either a declined plane S2 (see FIG. 3*b*) or an inclined plane S3 (see FIG. 3*c*) will now be described in greater detail. As may now be seen, the rowing machine 10 is selectively repositioned into either the declined or inclined plane by mounting it on top of the support apparatus 30 pre-arranged in either a first position in which the front platform 40 is elevated and the back platform 42 is locked to the frame 32 or a second position in which the front platform 40 is locked to the frame 32 and the back platform 42 is elevated. More specifically, to operate the rowing machine 10 in the declined position, the support lever 34 is pivoted until the front platform 40 is generally flush with the front side 32*a* of the frame 32. The support apparatus 30 is then locked into a first position by inserting a pin through apertures in the flange 51*a* and the front platform 40.

After locking the support apparatus 30 into the first position, the exercise machine 10 is lifted off of the support surface 14 and placed onto the support apparatus 30 such that bottom side surfaces of the front and back support beams 16*a* and 16*b* rest on upper side surfaces of the front and back platforms 40 and 42, respectively. The rowing machine 10 is then secured in position on the support apparatus 30 using a locking mechanism which may be provided as part of the rowing machine 10, the support apparatus 30 or both. For example, as illustrated herein, the locking mechanism is comprised of straps 54, 56, 58 and 60 provided on the support apparatus 30. The precise manner in which the straps 54, 54, 58 and 60 are used to secure the rowing machine 10 to the support apparatus 30 may vary depending on the particular configuration of the front and back support beams 16*a* and 16*b*, the design of the straps 54, 56, 58 and 60 and/or the preferences of the user. For example, as illustrated in FIG. 3*b*, the straps 54, 56, 58 and 60 may be wrapped around the rail member 12. Conversely, if each one of the support beams 16*a* and 16*b* terminates in a foot projecting outwardly therefrom, the straps 54, 56, 58 and 60 may instead be wrapped around respective ones of those feet. After wrapping the straps 54, 56, 58 and 60 around a selected portion of the rowing machine 10, the straps are then secured in place, for example, by securing each strap to itself along its length.

A variety of techniques may be used to reposition the exercise machine 10 from the declined position illustrated in FIG. 3*b* to the inclined position illustrated in FIG. 3*c*. All such techniques, however, involve unlocking of the front platform 40 by pulling the pin 51 out of the front platform 40, pivoting the support lever 34 into a second position in which the front platform 40 is elevated and the back platform 42 is generally flush with the frame 32 and locking the back platform 42 to the frame 34 by inserting the pin 51 through apertures formed in the flange 51*b* and the back platform 42. If desired, the straps 54, 56, 58 and 60 may be unsecured and the rowing machine 10 lifted off of the support apparatus 30 and placed on the support surface 14 before pivoting the support lever 34 into the second position. In this scenario, the rowing machine 10 would then be re-secured to the front and back platforms 40 and 42 after the support lever 34 is locked in the second position. Of course, instead of manually changing positions, it is contemplated that the use of hydraulics, pneumatics, or electrical motors could allow for this procedure to be automated.

In the foregoing description, mechanisms are disclosed to secure the front and back platforms 40 and 42 to the frame 32 and to secure the rowing machine 10 to the front and back platforms 40 and 42. It should be clearly understood, however, that, not only are a wide variety of locking mechanisms contemplated to provide each of the aforementioned securements, it is equally contemplated that one or both of the aforementioned locking mechanisms may be omitted from the disclosed support apparatus 30 and that the locking mechanisms are provided only to enhance the stability of the disclosed combination an exercise machine and a support apparatus which modifies the stroke axis thereof. For example, the additional stability provided by securing the exercise machine 10 to the support apparatus 30 may instead be provided by weighting the exercise machine 10 and/or the support lever 34 appropriately.

As previously set forth, in the preferred embodiment of the invention, the ratio of the back portion 38 of the support lever 34 to the front portion 36 of the support lever 34 is approximately 2:1. This ratio produces a corresponding relationship of the elevation of the back platform 42 above the support surface 14 when the support apparatus 30 is in the second position to the elevation of the front platform 40 above the support surface 14 when the support apparatus 30 is in the first position. Accordingly, it is preferred that the elevation of the back end of the rowing machine 10 when used in the declined position to the elevation of the front end of the rowing machine 10 when used in the inclined position be approximately 2:1. Thus, in a preferred embodiment of the exercise protocols to be hereinafter disclosed which involve performing at least one stroke in a declined plane and at least one stroke in an inclined plane, the preferred ratio of the declined plane to the inclined plane would be approximately 2:1.

Of course, the elevation of the front and back platforms 40 and 42 above the support surface 14 will vary depending on the dimensions of the frame 32 and the juncture angle between the front portion 36 and the back portion 38 of the support lever 34. In the drawings, the juncture angle appears to be roughly 135 degrees. However, it is fully contemplated that an alternate juncture angle may be selected to achieve the desired elevations of the front and back platforms 40 and 42. More specifically, in the preferred embodiment of the invention, it is preferred that the front platform 40 be elevated approximately 16-inches above the support surface 14 while the back platform 42 be elevated approximately 32-inches above the support surface 14.

As will be more fully described below, use of the rowing machine 10 in an exercise routine after elevating either the front and back platforms 40 and 42 produces an exercise stimulus significantly greater than the use of the rowing machine 10 in the traditional flat ground horizontal plane. As a result, depending on the physical condition of a prospective user, the use of the rowing machine 10 with the aforementioned 16-inch front platform elevation or the 32-inch back platform elevation may be too strenuous a workout for some users. Accordingly, it is contemplated that, in certain embodiments of the invention, the elevation of the back and front platforms 42 and 40 should be modifiable while the overall ratio between the relative elevations of the back and front platforms is maintained at the desired 2:1 ratio. It is further contemplated that the exercise protocols to be hereinbelow described not only may be performable at different elevations depending on the physical condition of the user but that further embodiments of these exercise protocols include the use of the exercise machine 10 with the platforms 40 and 42 at a first set of elevations for a first period of time and the use of the exercise machine 10 with the platforms 40 and 42 at a second set of elevations for a second period of time. For example, it is contemplated that a novice user should perform the disclosed exercise protocols with the front platform 40 elevated two inches and the back platform 42 elevated 4 inches. After the physical condition of the user has improved, typically, after about 3–6 months of use at the aforementioned elevations, the exercise protocols should be performed with the front platform 40 elevated six inches and the back platform 42 elevated twelve inches. After continued improvement of the physical condition of the user, the exercise protocols should be performed with the front and back platforms 40 and 42 at their full elevations—sixteen and thirty-two inches, respectively.

Figure 3D:
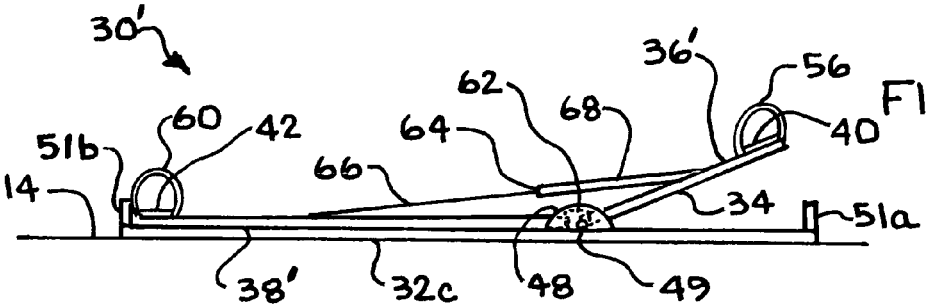
FIG. 3*d* is a side view of an alternate embodiment of the support apparatus of FIG. 2 which enables the rowing machine of FIG. 1 to be selectively operated in plural inclined and plural declined positions.

The support apparatus 30 illustrated in FIGS. 2 and 3*a–c* is limited to a fixed set of elevations. Such a support apparatus is not well suited for modifying the set of elevations, for example, increasing the elevation as the user's physical condition improves. In FIG. 3*d*, however, an alternate embodiment of the support apparatus is shown, hereafter referred to as support apparatus 30', which enables the user to adjust the set of elevations. Here, the support lever 34 is comprised of discrete sections 36' and 38' coupled together by a flexible joint 62 in which respective ends of the sections 36' and 38' are engagingly received. Adjustable strut member 64 is coupled between the sections 36' and 38' to adjustingly change the juncture angle between the sections 36' and 38'. By changing the juncture angle between the sections 36' and 38', the user can adjust the relative elevations of the front and back platforms 40 and 42. As contemplated for this embodiment, the adjustable strut member 64 is comprised of a retractable shaft 66 and a rotatable shaft housing 68 coupled to the retractable shaft 66. By continuously rotating the housing 68 in a first direction, the shaft 66 will increasingly retract into the housing 68, thereby decreasing the junction angle between the sections 36' and 38' and thus increasing the relative elevation of the front and back platforms 40 and 42. Conversely, by continuously rotating the housing 68 in a second direction, the shaft 66 will extend from the housing 68, thereby increasing the juncture angle between the sections 36' and 38' and thus decreasing the relative elevation of the front and back platforms 40 and 42. Preferably, the adjustable strut member 64 would be sized to enable the support apparatus 30' to reach the full horizontal position in which neither the front platform 40 nor the back platform 42 is elevated above the support surface 14, i.e., to allow for zero elevation. Of course, if the adjustable strut member 64 cannot be sized to enable the support apparatus 30' to be placed in the full horizontal position, alternately, the adjustable strut member 64 can be equipped with a so-called "quick-disconnect" which will separate the retractable shaft 66 from the housing 68, thereby enabling the support apparatus 30' to reach the full horizontal position. Of course, it is fully contemplated that the disclosed strut member 64 is but one of a wide variety of mechanisms that may be used to adjust the juncture angle between the sections 36' and 38', and that a number of other mechanisms would be suitable for the uses contemplated herein.

In another embodiment of the invention, it is contemplated that an electric motor may be used to pivot the support lever 34 from the first position illustrated in FIG. 3*b* in which the front platform 40 is generally flush with the frame 32 and the back platform is elevated to the second position illustrated in FIG. 3*c* in which the front platform 40 is elevated and the back platform 42 is generally flush with the frame 32. While a variety of techniques may be used to mechanically drive the support lever 34 between the first and second positions, one suitable technique would be to replace the securing member 44 with a drive shaft coupled to and rotatable by the electric motor. The drive shaft should be tightly fitted within the aperture 51 formed in the support lever 34 such that rotation of the drive shaft would impart a pivot motion to the support lever 34. This embodiment is considered to be particularly advantageous in that, by pivoting the support lever 34 between the first position illustrated in FIG. 3*b* and the second position illustrated in FIG. 3*c*, the rowing machine 10 may be positioned in a virtually unlimited number of declined and inclined positions.

Figure 4A:
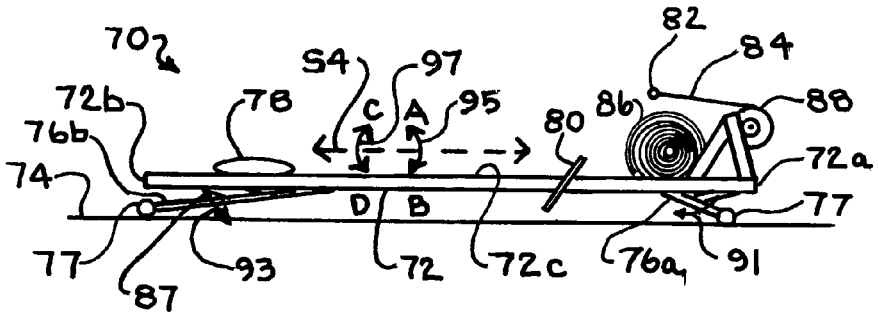
FIG. 4*a* is a side view of a rowing machine configured for operation in plural inclined and plural declined positions.
Figure 4B:
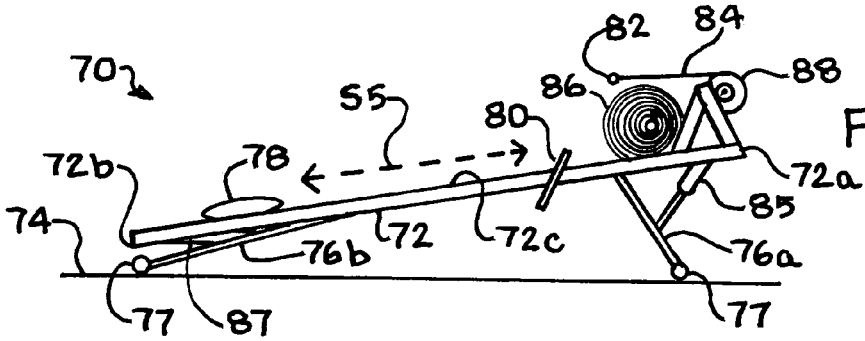
FIG. 4*b* is a side view of the rowing machine of FIG. 4*a* in a full-inclined position.
Figure 4C:
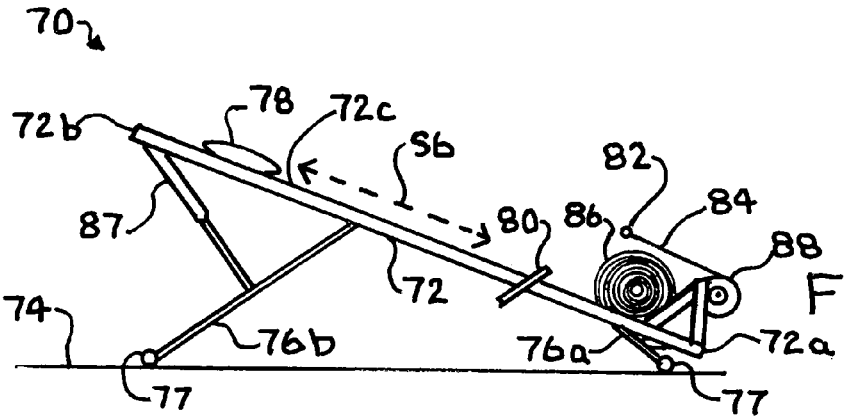
FIG. 4*c* is a side view of the rowing machine of FIG. 4*a* in a full-declined position.

Referring next to FIGS. 4*a–c*, a rowing machine 70 configured for operation in plural inclined and plural declined planes shall now be described in greater detail. The multi-planar rowing machine 70 includes a rail member 72 supportably mounted above a generally horizontal support surface 74, for example, a floor. The rail member 72 is supported above the support surface 74 by a pair of front support beams 76*a* and a pair of rear support beams 76*b*, only one of each of which is visible in FIGS. 4*a–c*. The multi-planar rowing machine 70 further includes a seat 78, a pair of foot pads 80 (only one of which is visible in FIGS. 4*a–c*), and a bar 22. The seat 78 is slideably attached to the rail member 72 by a sliding mechanism, hidden from view in FIGS. 4*a–c*, which enables the seat 78 to slide along the rail 78. Typically, the sliding mechanism includes a slot longitudinally formed along an upper side surface 72*c* of the rail member 72 such that a projection (not visible) extending downwardly from a lower side surface of the seat 78 may be slideably inserted therein. Each one of the foot pads 80 (only one of which is visible in FIGS. 4*a–c*) is coupled to a respective side of the rail member 72. The bar 82, which is typically grasped and pulled by a user during an exercise routine, is shown in an artificially elevated position in FIGS. 4*a–c* to enhance the visibility thereof. The bar 82 is coupled to a retractable cable 84, which, in turn is coupled to an air fan wheel 86 via a pulley 88 and a ratchet gear mechanism (not shown) located within the air fan wheel 86.

The front support beams 76*a* are pivotably coupled to the rail member 72 such that the front support beam 76*a* is freely pivotable between a first position illustrated in FIGS. 4*a* and 4*c* and a second position illustrated in FIG. 4*b*. Similarly, each one of the back support beams is pivotably coupled to the rail member 72 such that the back support beam 76*b* is freely pivotable between a first position illustrated in FIGS. 4*a* and 4*b* and a second position illustrated in FIG. 4*c*. It is generally preferred that the ratio of the distance that a back end 72*b* of the multi-planar rowing machine 70 may be elevated above the full-horizontal position relative to the distance that a front end 72*a* may be elevated above the full-horizontal position is approximately 2:1. Accordingly, to achieve this objective, and as illustrated in FIGS. 4*a–*4*c*, the back support beam 76*b* would have a length roughly twice that of the front support beam 76*a*.

In this embodiment, movement of the front support beam 76*a* between these positions is accomplished by a piston 85 mounted between the rail member 72 and the front support beam 76*a* at an acute angle thereto. The piston 85 is configured to selectively expand and/or retract to any point between a fully retracted position illustrated in FIGS. 4*a* and 4*c* and a fully expanded position illustrated in FIG. 4*b*. Again, to achieve the aforementioned 2:1 ratio, the piston 87 should be expandable to twice the length of the piston 85. It is contemplated that a variety of techniques may be used to drive the piston 85 between the fully expanded and the fully retracted positions. For example, a compressed air source (not shown) coupled to the piston 85 may be opened to initiate a flow of air into an interior chamber of the piston 85, thereby causing the piston 85 to expand from the position illustrated in FIG. 4*a* into the position illustrated in FIG. 4*b*. Conversely, a relief valve (also not shown) in communication with the interior chamber of the piston 85 may be opened to initiate a flow of air out of the interior chamber of the piston, thereby causing the piston 85 to retract from the position illustrated in FIG. 4*b* into the position illustrated in FIG. 4*c*.

Similarly, each one of the back support beams 76*b* is pivotably mounted to the rail member 72 such that the back support beam 76*b* is freely pivotable between a first position illustrated in FIGS. 4*a* and 4*b* and a second position illustrated in FIG. 4*c*. In this embodiment, movement of the back support beam 76*b* between these positions is accomplished by a piston 87 mounted between the rail member 72 and the back support beam 76*b* at an acute angle thereto. Like the piston 85, the piston 87 is configured to selectively expand and/or retract to any point between a fully retracted position illustrated in FIGS. 4*a* and 4*b* and a fully expanded position illustrated in FIG. 4*c* using any one of a variety of techniques. Accordingly, the pistons 85 and 87 may be variously configured as the aforedescribed pneumatic pistons or as hydraulic pistons. Furthermore, the pistons 85 and 87 may variously be manually or automatically actuated, for example, using one or more control knobs or an electronic console. Of course, various other mechanisms could be used to perform the adjustment of the support beams 76*a* and 76*b*, including hydraulic, pneumatic, electrical motors, etc.

In FIG. 4*a*, the multi-planar rowing machine 70 is in a full-horizontal position achieved by arranging each of the front support beams 76*a* and the back support beams 76*b* into the first position by driving the pistons 85 and 87 into the fully retracted position. Use of the multi-planar rowing machine 70 in the full-horizontal position would produce a rowing motion in which both the pull and flex phases of each stroke are along a stroke axis S4 located within a single plane generally horizontal and parallel with the support surface 74. To operate the multi-planar rowing machine 70 in a selected inclined position, the user would cause piston 85 to expand. As the piston 85 expands, the front support beam 76*a* would pivot, along pivot axis 91, from the first position illustrated in FIG. 4*a* towards the second position illustrated in FIG. 4*b*. As the front support beam 76*a* pivots, the front end 72*a* of the multi-planar rowing machine 70 begins to elevate, thereby pivots the stroke axis S4, in direction A along pivot axis 95, towards stroke axis S5. By allowing the piston 85 to fully expand, the user may elevate the front end 72*a* of the multi-planar rowing machine 70 to the fully inclined position illustrated in FIG. 4*b* in which the pull and flex phases are along an inclined stroke axis, specifically the stroke axis S5, and the front end 72*a* is elevated (approximately 16-inches for the preferred embodiment) above the full horizontal position illustrated in FIG. 4*a*.

To operate the multi-planar rowing machine 70 in a selected declined position, the user would cause the piston 87 to expand (if the multi-planar rowing machine 70 is in the full-horizontal position illustrated in FIG. 4*a*) or cause the piston 85 to retract and the piston 87 to expand (if the multi-planar rowing machine 70 is in an inclined position such as the full-inclined position illustrated in FIG. 4*b*). If the multi-planar rowing machine 70 is in the full-horizontal position, as the piston 87 expands, the back support beam 76*b* would pivot, along pivot axis 93, from the first position illustrated in FIG. 4*a* towards the second position illustrated in FIG. 4*c*. As the back support beam 76*b* pivots, the back end 72*b* of the multi-planar rowing machine 70 begins to elevate, thereby pivoting the stroke axis S4, in direction C along pivot axis 97, towards stroke axis S6. By allowing the piston 87 to fully expand, the user may elevate the back end 72*a* of the multi-planar rowing machine 70 to the fully declined position illustrated in FIG. 4*c* in which the pull and flex phases are along a declined stroke axis, specifically, the stroke axis S6, and the back end 72*b* is elevated (approximately 32-inches for the preferred embodiment) above the full-horizontal position illustrated in FIG. 4*a*. If the multi-planar rowing machine 70 is in an inclined position such as the full-inclined position illustrated in FIG. 4*b*, the user would need to both retract the piston 85 and expand the piston 87. It is contemplated that the retraction of the piston 85 and expansion of the piston 87 may either be executed in sequence or, if desired, simultaneously. If executed in sequence, by retracting the piston 85 first, the user would first cause the front support beam 76*a* to pivot, in the opposite direction along the pivot axis 91, from the second position illustrated in FIG. 4*a* to the first position illustrated in FIGS. 4*a* and 4*c*. In turn, the stroke axis of the multi-planar rowing machine 70 would pivot, in direction B along the pivot axis 95, from the stroke axis S5 towards the stroke axis S6. The user would then cause the piston 87 to expand in the manner previously described. Finally, from the full-declined position illustrated in FIG. 4*c*, the user may return the multi-planar rowing machine 70 to the full-horizontal position by retracting the piston 87, thereby causing the back support beam 76 to pivot, in the opposite direction along the pivot axis 93, from the second position illustrated in FIG. 4*c* to the first position illustrated in FIGS. 4*a* and 4*b*. In turn the stroke axis of the multi-planar rowing machine 70 would pivot in direction D along the pivot axis 97, from the stroke axis S6 towards the stroke axis S4.

By utilizing a pair of pistons 85 and 87 to pivot the front and back support beams 76*a* and 76*b*, the user may operate the multi-planar rowing machine 70 in virtually an unlimited number of inclined positions ranging between the full-horizontal position of FIG. 4*a* and the full-inclined position of FIG. 4*b* as well as a virtually unlimited number of declined positions ranging between the full-horizontal position of FIG. 4*a* and the full-declined position of FIG. 4*c*.

Figure 5A:
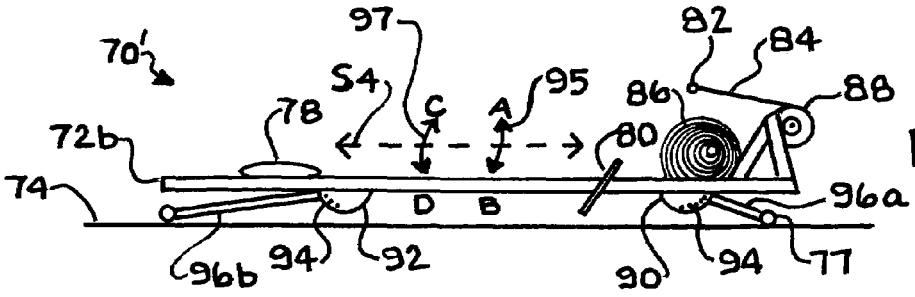
FIG. 5*a* is a side view of an alternate embodiment of a rowing machine configured for operation in plural inclined and declined positions.
Figure 5B:
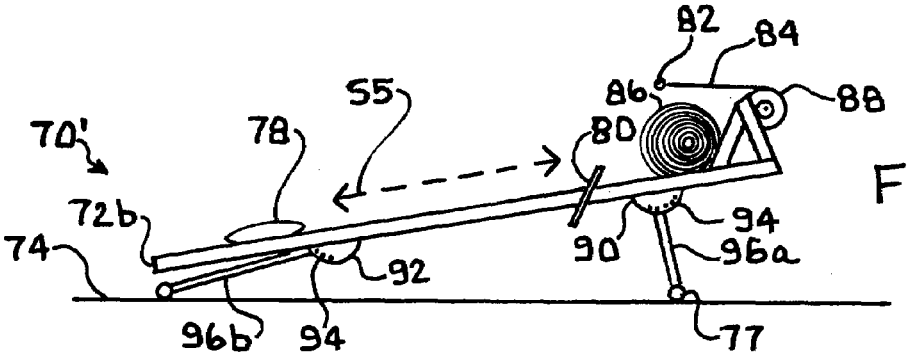
FIG. 5*b* is a side view of the rowing machine of FIG. 5*a* in a full-inclined position.
Figure 5C:
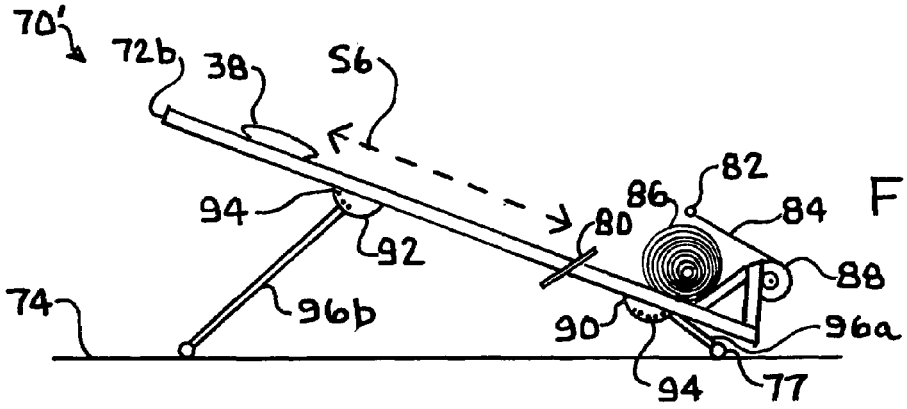
FIG. 5*c* is a side view of the rowing machine of FIG. 5*a* in a full-declined position.

Referring next to FIGS. 5*a–c*, an alternate embodiment of the multi-planar rowing machine 70, hereafter referred to as multi-planar rowing machine 70', will now be described in greater detail. The multi-planar rowing machine 70' operates in a manner similar to the multi-planar rowing machine 70. Here, however, the multi-planar rowing machine 70' is limited to operation in a discrete number of inclined positions and a discrete number of declined positions. More specifically, for the multi-planar rowing machine 70', the piston-driven-type support structure of the multi-planar rowing machine 70 has been replaced by a pin-and-socket-type support structure. The pin-and-socket type support structure includes a front flange member 90 and a back flange member 92, both coupled to the rail member 72 or another portion of the support structure for the rowing machine 70' not visible in FIGS. 5*a–c*. A series of apertures 94 are formed in each of the front and back flange members 90 and 92. Preferably, the apertures 94 formed on each of the front and back flange members 90 and 92 are formed in a generally circular-spaced relationship. Front and back support members 96*a* and 96*b* are pivotably coupled to the front and back flange members 90 and 92, respectively. The front support member 96*a* is pivotable between a first position illustrated in FIG. 5*a* and a second position illustrated in FIG. 5*b* and secured in a selected one of these (or an intermediate) position by a first locking pin (not shown) which extends through the front support member 96*a* and into one of the apertures 94. Similarly, the back support member 96*b* is pivotable between a first position illustrated in FIG. 5*a* and a second position illustrated in FIG. 5*c* and secured in a selected one of these (or an intermediate position) by a second locking pin (also not shown) which extends through the back support member 96*b* and into one of the apertures 94. To pivot the front and second support members 96*a* and 96*b* between positions, the corresponding locking pin is removed. The exercise machine 70' is then repositioned until the aperture in the support member 96*a* or 96*b* being pivoted aligns with the selected one of the apertures 94. The locking pin is then re-inserted through the support member 96*a* or 96*b* and the selected aperture to secure the support member 96*a* or 96*b* in the selected position.

Having described and illustrated various multi-planar exercise apparatus, specifically, a multi-planar rowing machine uniquely configured for selective operation in either inclined or declined positions, various exercise protocols suitable for use with the multi-planar exercise apparatus shall now be described in greater detail. The protocols shall be described with respect to a series of schematic diagrams, of which FIGS. 6*a* through 6*m* disclose exercise protocols for use in conjunction with a multi-planar rowing machine 100 in the declined position while FIGS. 7*a* through 7*e* disclose exercise protocols for use in conjunction with a multi-planar rowing machine 100 in the inclined position. Generally, however, it should be noted that the exercise-stimulus effect of performing an exercise protocol using the multi-planar rowing machine 100 in either the declined position or the inclined position is significant. More specifically, the combination of isokinetic resistance and resistance due to gravity resulting from having to "flex" uphill against gravity and "pull" downhill while stabilizing the torso in the inclined position and "pull" uphill against gravity and "flex" downhill in the declined position has created a new exercise potential heretofore unknown for rowing machines. As a result, the exercise protocols disclosed herein produce significant resistance to both flexors and extensors in the three major body segments—trunk, upper leg and lower leg. Furthermore, it should be noted that the elbow flexors (or biceps) are constantly stimulated by the action of rowing in either the inclined or declined positions while the elbow extensors (or triceps) act as antagonists to the biceps or as unresisted elbow extensors during a flex phase of a stroke in either the inclined or declined positions.

In the foregoing schematic diagrams, the rowing machine has been greatly simplified for ease of clarity and illustration. More specifically, the multi-planar rowing machine 100 appears as a simple quadrilateral in which a lowermost boundary 100*b* represents that portion of the multi-planar rowing machine 100 which rests on a support surface 102 and an uppermost boundary 100*a* represents a stroke axis for the multi-planar rowing machine 100. A front side boundary 100*c* of the quadrilateral being illustrated as generally orthogonal to the lowermost boundary 100*b* indicates that a front end of the multi-planar rowing machine 100 is unelevated. Conversely, the front side boundary 102*c* of the quadrilateral being illustrated at an acute angle relative to the lowermost boundary 102*b* indicates that the front end of the multi-planar rowing machine 100 is elevated. Similarly, a back side boundary 100*d* of the quadrilateral being illustrated as generally orthogonal to the lowermost boundary 100*b* indicates that a back end of the multi-planar rowing machine 100 is unelevated. Conversely, the back side boundary 100*d* of the quadrilateral being illustrated at an acute angle relative to the lowermost boundary 102*b* indicates that the back end of the multi-planar rowing machine 100 is elevated. Components of the multi-planar rowing machine 100 deemed relevant to various ones of the exercise protocols disclosed herein are also schematically illustrated in FIGS. 6*a–m*, 7*a–e*, and 8*a–b*. These components include a pair of foot pads 104 and 106, a bar 108 and a cable 110. All other components of the multi-planar rowing machine 100 have been omitted from FIGS. 6*a* through 7*e* for ease and clarity of illustration.

In its broadest sense, the exercise protocol would be to perform at least one stroke with the multi-planar rowing machine 100 in the declined position illustrated in FIGS. 6*a* through 6*m* or in the inclined position illustrated in FIGS. 7*a* through 7*e*. In another, the exercise protocol would be to perform a combination of at least one stroke with the multi-planar rowing machine 100 in the inclined position and at least one stroke with the multi-planar rowing machine 100 in the declined position. In still another, the exercise protocol would be to perform a combination of plural strokes as part of a low intensity aerobic workout, a high intensity anaerobic workout, or a moderate intensity mixed aerobic/anaerobic workout.

Whether performed in the inclined or declined position, each stroke is comprised of two phases—a "pull" phase and a "flex" phase. The start of the pull phase of a stroke performed with the multi-position rowing machine 100 in the declined position may be seen by reference to FIG. 6*a*. Here, the multi-planar rowing machine, and the stroke axis 100*a*, are in a declined position. As previously mentioned, if the user 112 has frequently used the multi-planar rowing machine 100 (or if the user 112 is in good physical condition), a back end of the multi-planar rowing machine 100 should elevated thirty-two inches above the full-horizontal position illustrated in phantom in FIG. 6*a*.

Figure 6A:
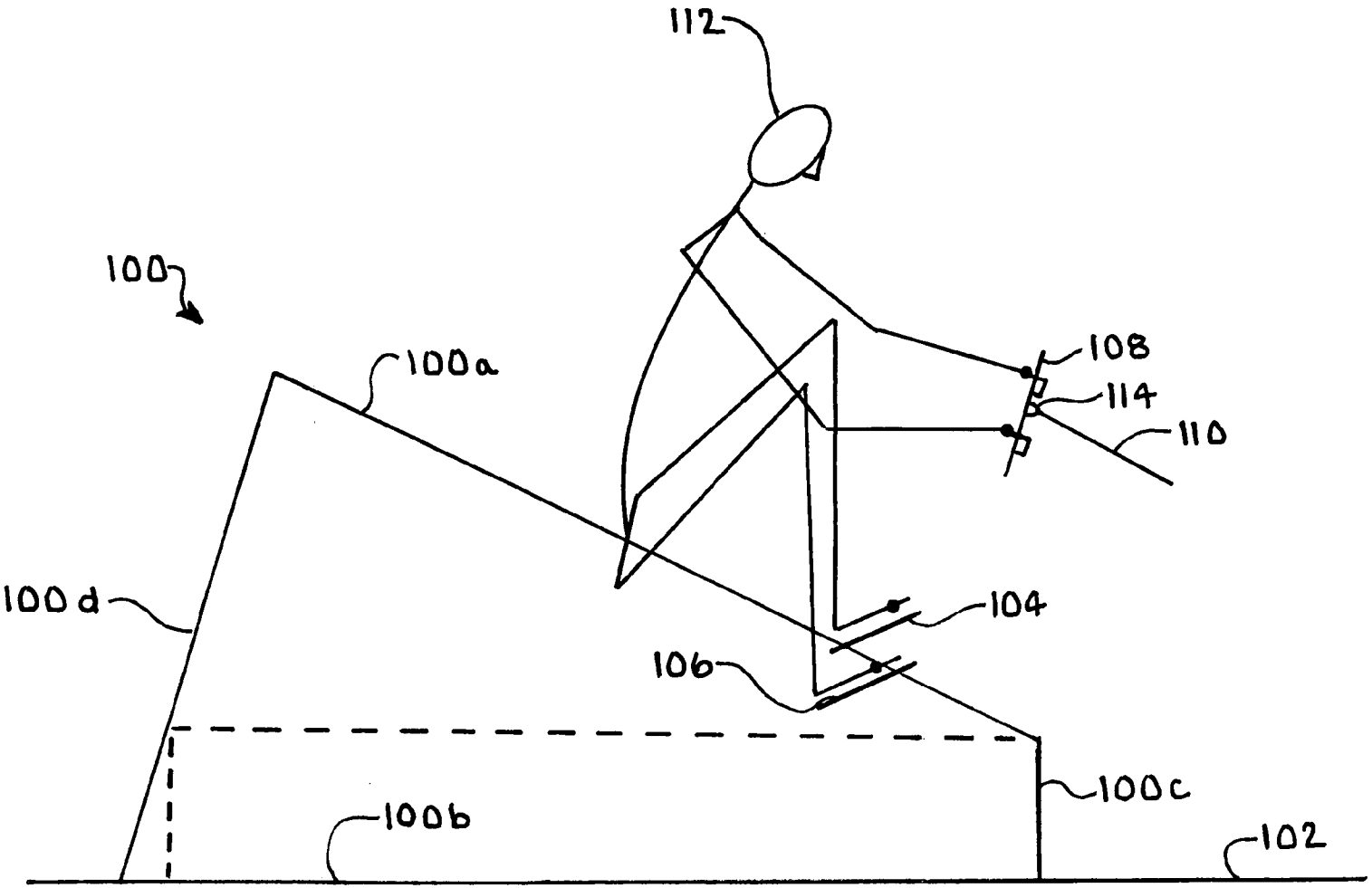
FIG. 6*a* is a schematic view of a multi-planar rowing machine in a declined position and a user at a start point for a pull phase of a stroke.
Figure 6B:
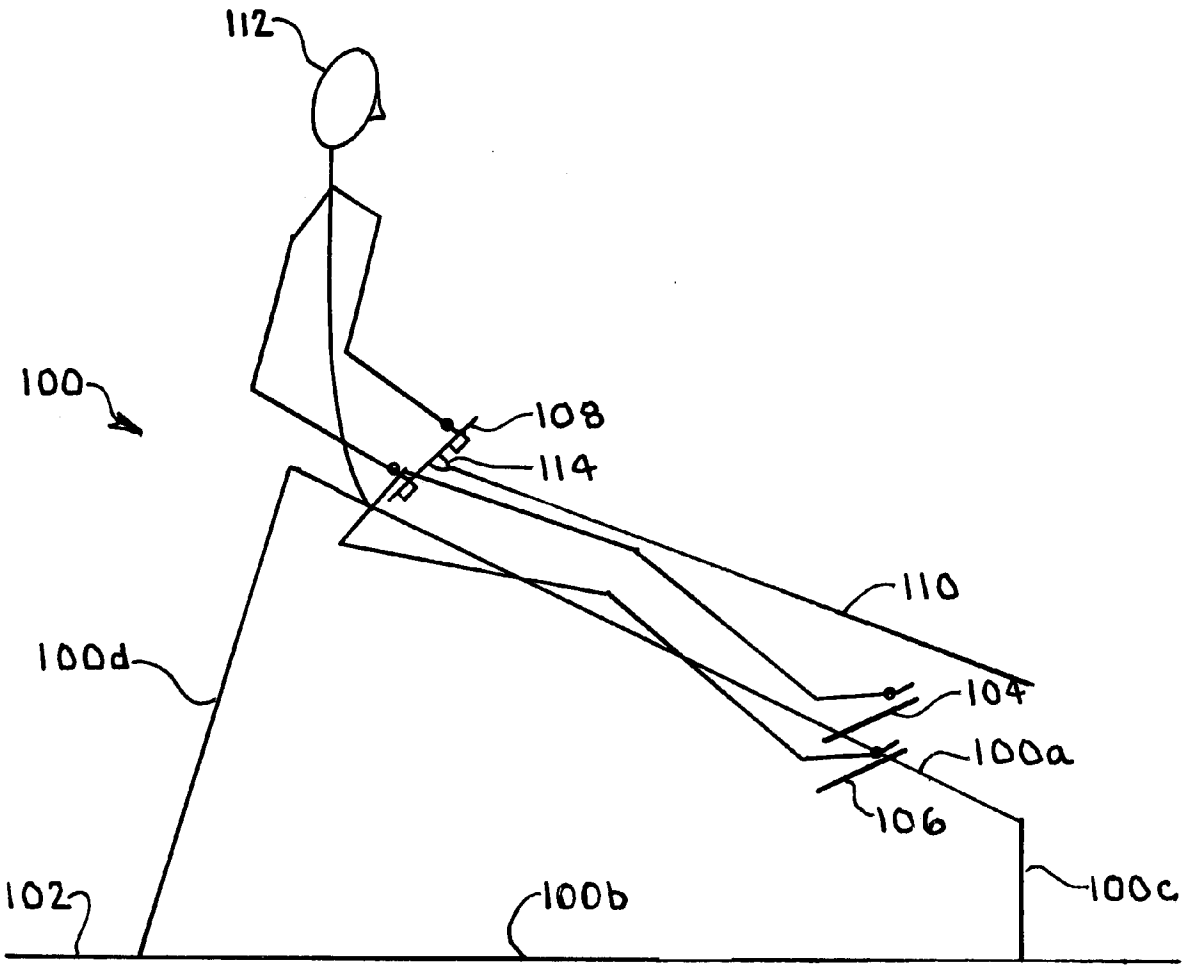
FIG. 6*b* is a schematic view of a multi-planar rowing machine in a declined position with the user at an end point for a heels-off, wrists-even, low-pull phase of a stroke.

The major body segments trained by performing a selected exercise protocol with the multi-planar rowing machine 100 in the declined position, include the gastrocnemius/soleus of the calf, the quadriceps of the thigh and the spinal erectors of the torso with emphasis on the latissimus dorsi; pectoralis major and minor; teres major and minor subscapularis, supra-spinatus and infra-spinatus of the rotator cuff; and deltoid muscles. Starting from the exercise position illustrated in FIG. 6*a* with legs retracted, feet firmly planted on foot pads 104 and 106 in a "heels-on" position, arms extended with the wrists even with the arms and the bar 108 grasped such that cable attachment 114 faces away from the user 112, the user 112 performs a pull phase of a stroke by extending their legs and retracting their arms until the legs are fully extended and the arms are fully retracted as illustrated in FIG. 6*b*. The user 112 then completes the stroke by performing a flex phase by retracting their legs and extending their arms until the arms are fully extended and the legs are fully retracted as illustrated in FIG. 6*a*.

Figure 6C:
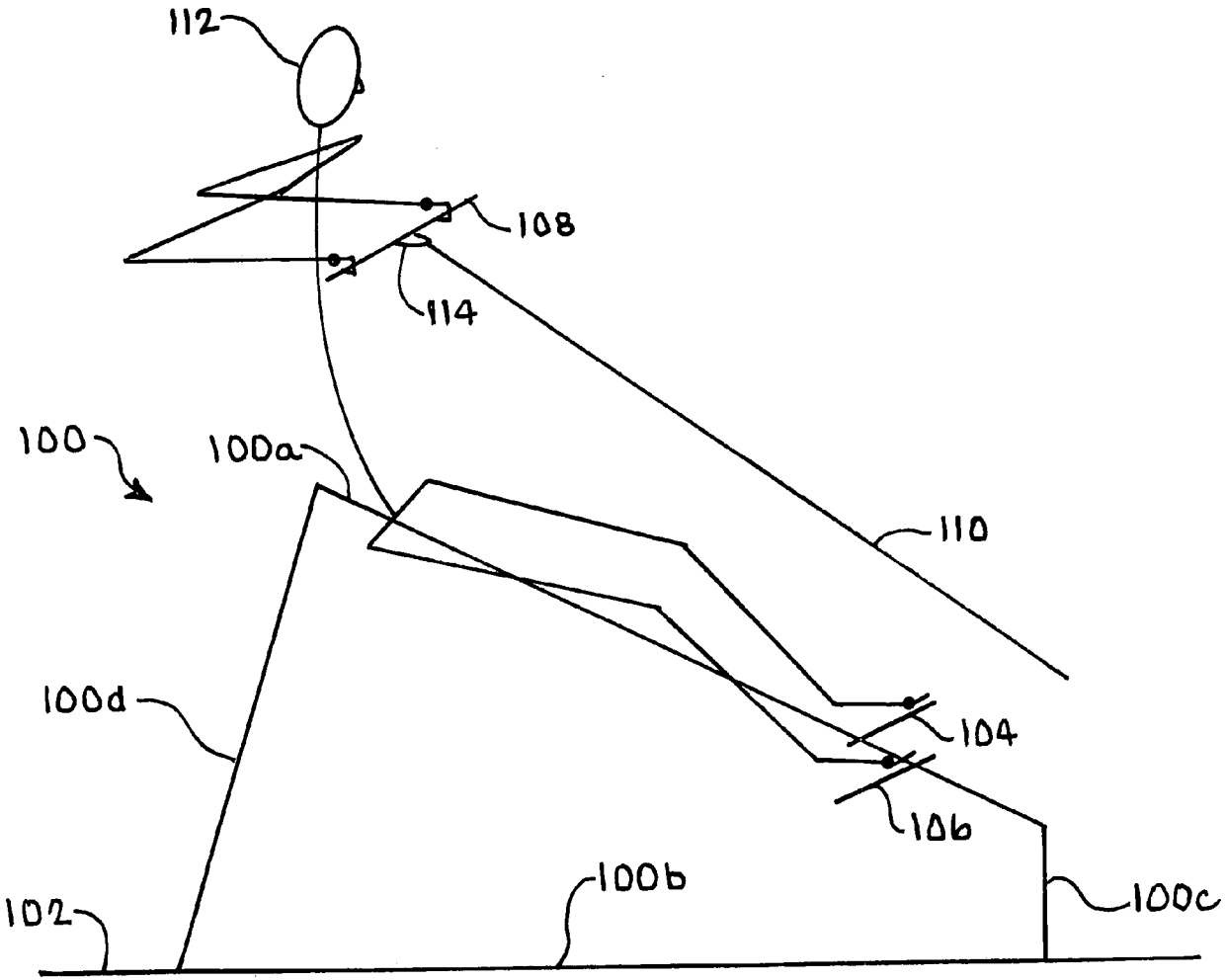
FIG. 6*c* is a schematic view of a multi-planar rowing machine in a declined position with the user at an end point for a heels-off, wrists-even, mid-pull phase of a stroke.
Figure 6D:
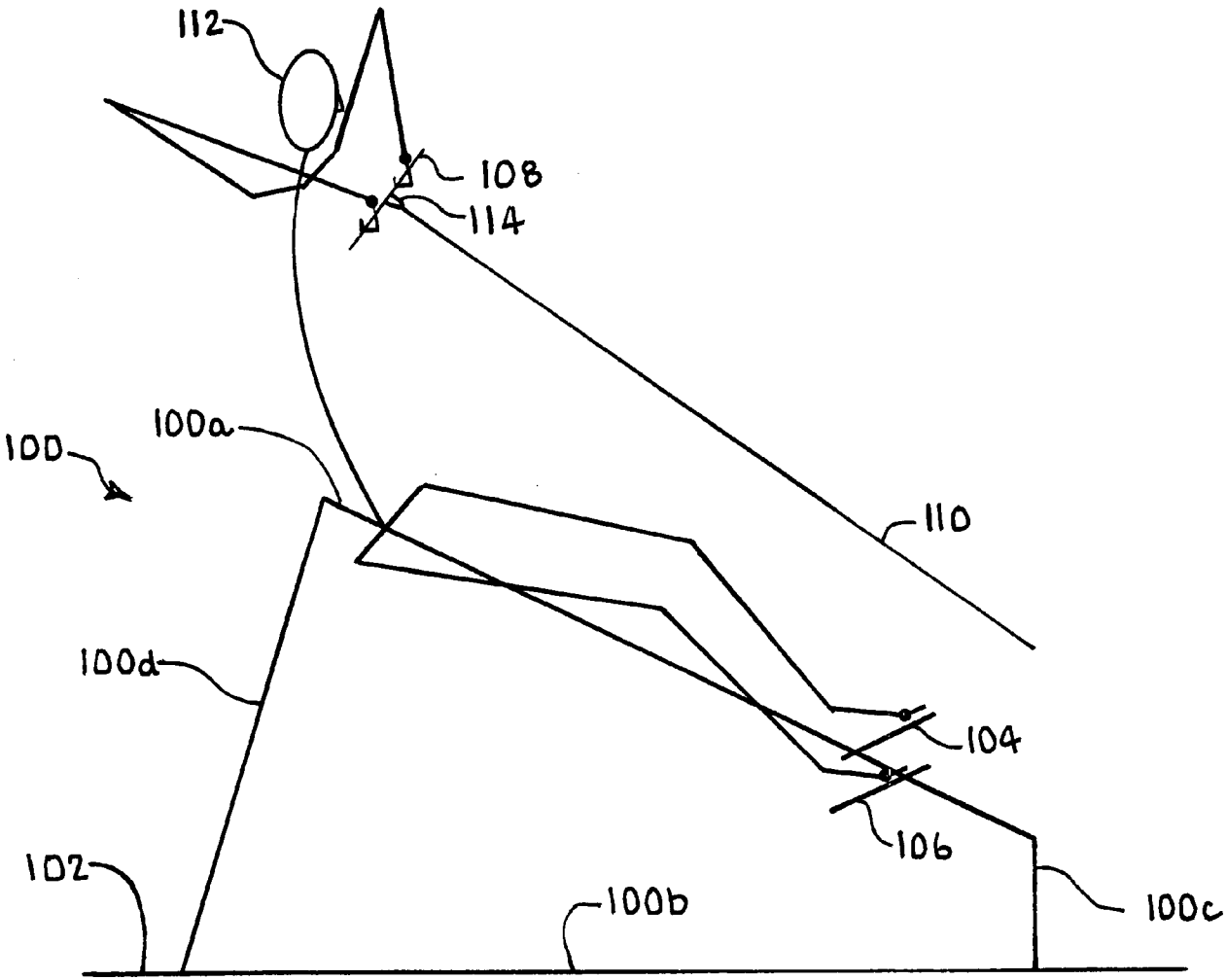
FIG. 6*d* is a schematic view of a multi-planar rowing machine in a declined position with the user at an end point for a heels-off, wrists-even, high-pull phase of a stroke.

The pull phase illustrated in FIG. 6*b* is generally referred to as a "low" pull phase because the arms are retracted such that the bar 108 is brought to a position generally near the waist. Depending on the particular muscle group to be trained, the user may select an alternate exercise protocol which includes, either in place of or in addition to the aforementioned at least one stroke in the low pull phase, at least one stroke having a "mid" (or torso) pull phase and/or at least one stroke having a "high" pull phase. In the mid pull phase, the arms are retracted such that the bar 108 is brought to a position generally near the chest as shown in FIG. 6*c*. By selecting an exercise protocol which includes a mid pull phase, major muscle emphasis is directed to the rhomboids and scalenius of the upper mid back and the long head of the triceps. In the high pull phase, the arms are retracted such that the bar 108 is brought to a position generally near the neck as shown in FIG. 6*d*. By selecting an exercise protocol which includes a high pull phase, major muscle emphasis is directed to the trapezius and the levator scapulae of the neck.

Figure 6E:
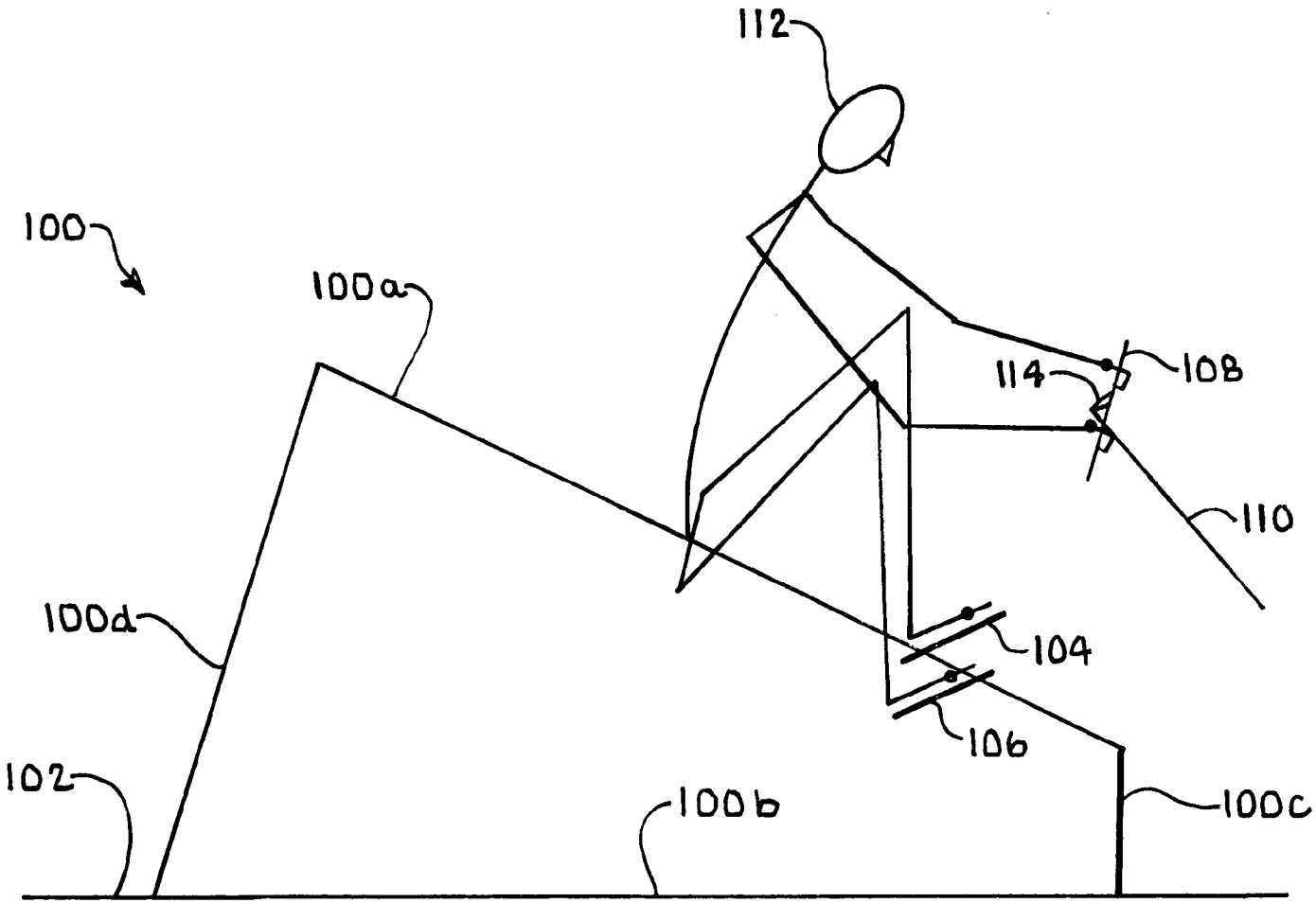
FIG. 6*e* is a schematic view of a multi-planar rowing machine in a declined position with the user at a start point for a heels-off, wrists-down, mid-pull phase of a stroke.
Figure 6F:
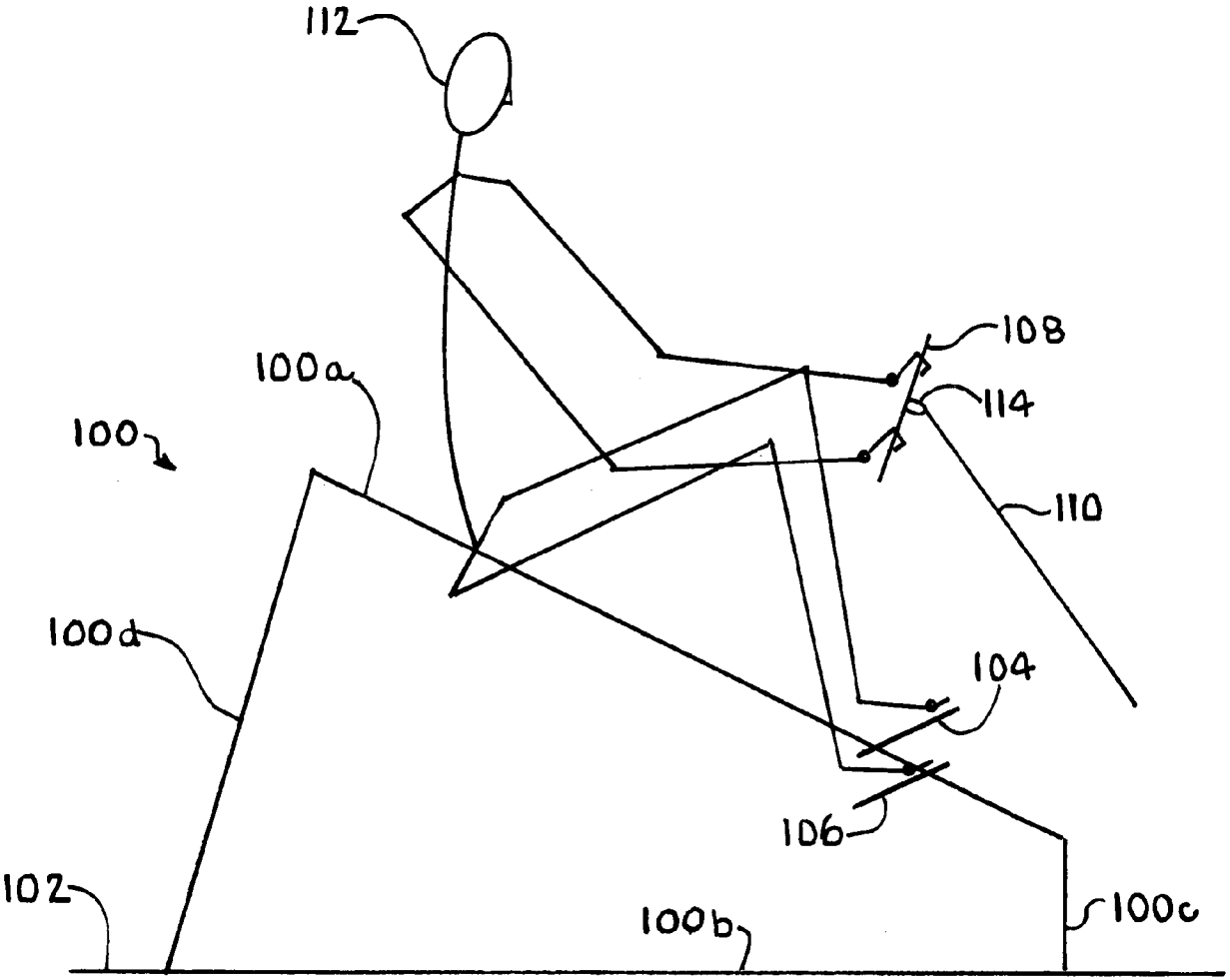
FIG. 6*f* is a schematic view of a multi-planar rowing machine in a declined position with the user at an intermediate point for a heels-off, wrists-down, mid-pull phase of a stroke.
Figure 6G:
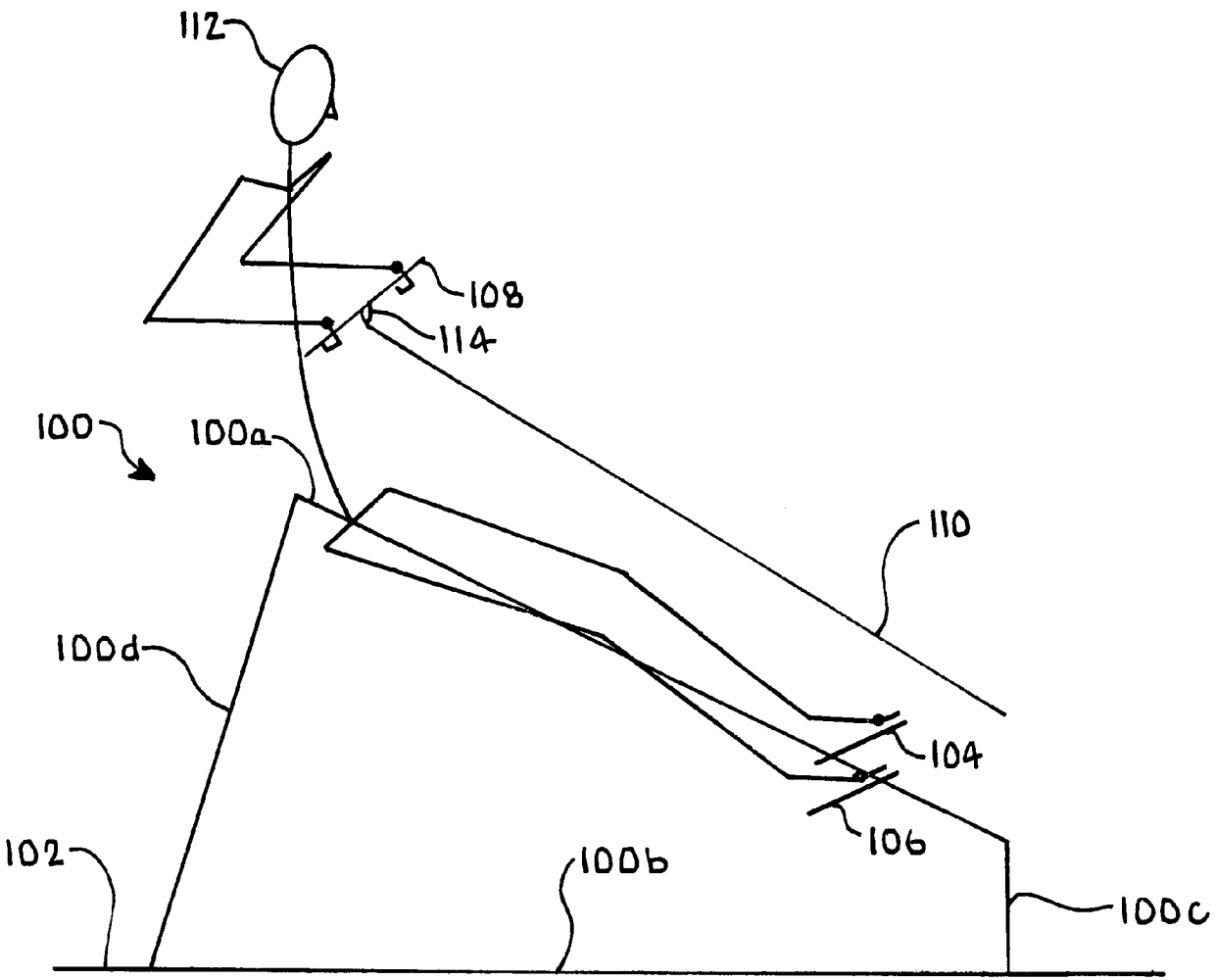
FIG. 6*g* is a schematic view of a multi-planar rowing machine in a declined position with the user at an end point for a heels-off, wrists-down, mid-pull phase of a stroke.

In the exercise protocols hereinabove described, the bar 108 is held in a position such that the cable attachment 114 faces away from the user 112. If desired, the user 112 may select a variant of the aforementioned exercise protocols by modifying the manner in which the bar 108 is held during the stroke. By selecting such an exercise protocol, the user 112 may better emphasize training of the hand/wrist flexion. One such exercise protocol is illustrated in FIGS. 6*e* through 6*g*. As may now be seen, after grasping the bar 108, the user 112 turns their wrists downwardly about 1 to 1½ inches to place the wrists in a "wrists-down" position. By placing the wrists in this position, the cable attachment 114 is turned down about 90 degrees, thereby placing the cable attachment 114 in a first generally orthogonal relationship with the cable 110. The user 112, then initiates either a low-pull, high-pull or, as illustrated in FIGS. 6*f* and 6*g*, mid-pull phase. As the user 112 performs a selected pull phase, the cable attachment 114 passively aligns with the cable 110 (see FIG. 6*f*) as the force of the legs and torso temporarily overwhelm the hand/wrist flexors. At the end of the pull phase, however, the combined force of the legs and torso declines and the smaller hand/wrist flexors begin to dominate, thereby enabling the user 112 to complete a dynamic hand/wrist flexion movement (see FIG. 6*g*) as soon as the hand/wrist flexors become dominant.

Figure 6H:
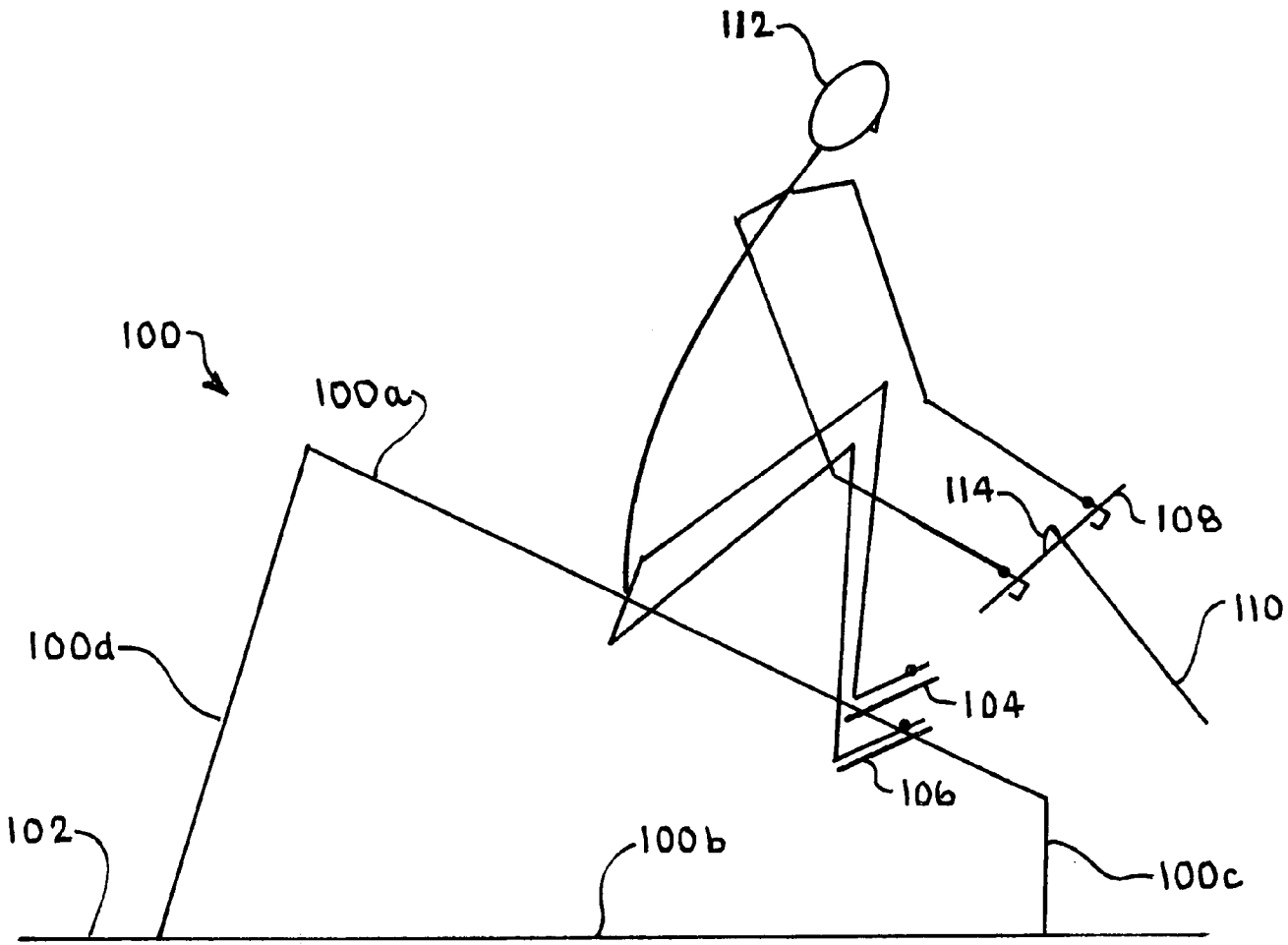
FIG. 6*h* is a schematic view of a multi-planar rowing machine in a declined position with the user at a start point for a toes-up, wrists-up, mid-pull phase of a stroke.
Figure 6I:
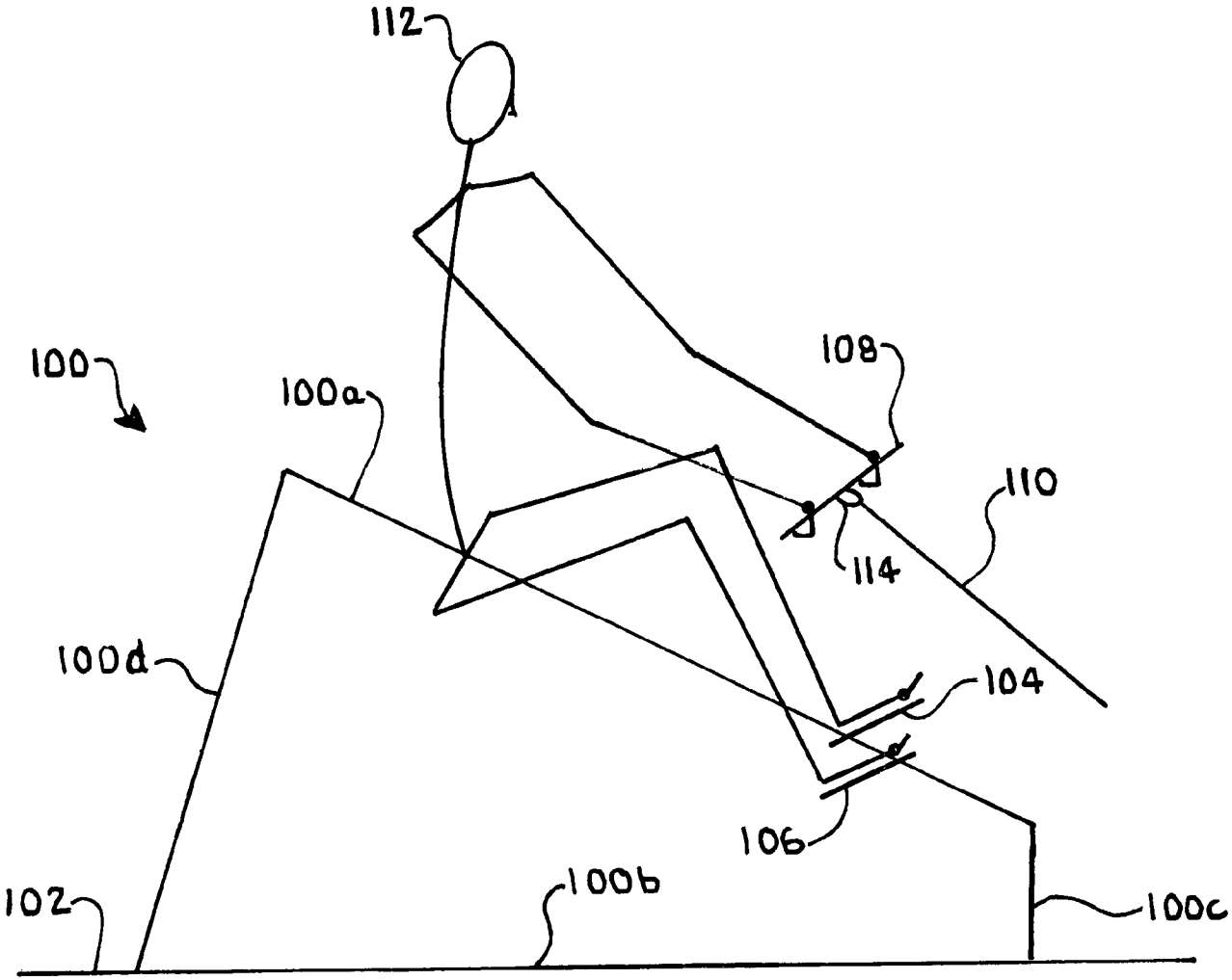
FIG. 6*i* is a schematic view of a multi-planar rowing machine in a declined position with the user at an intermediate point for a toes-up, wrists-up, mid-pull phase of a stroke.
Figure 6J:
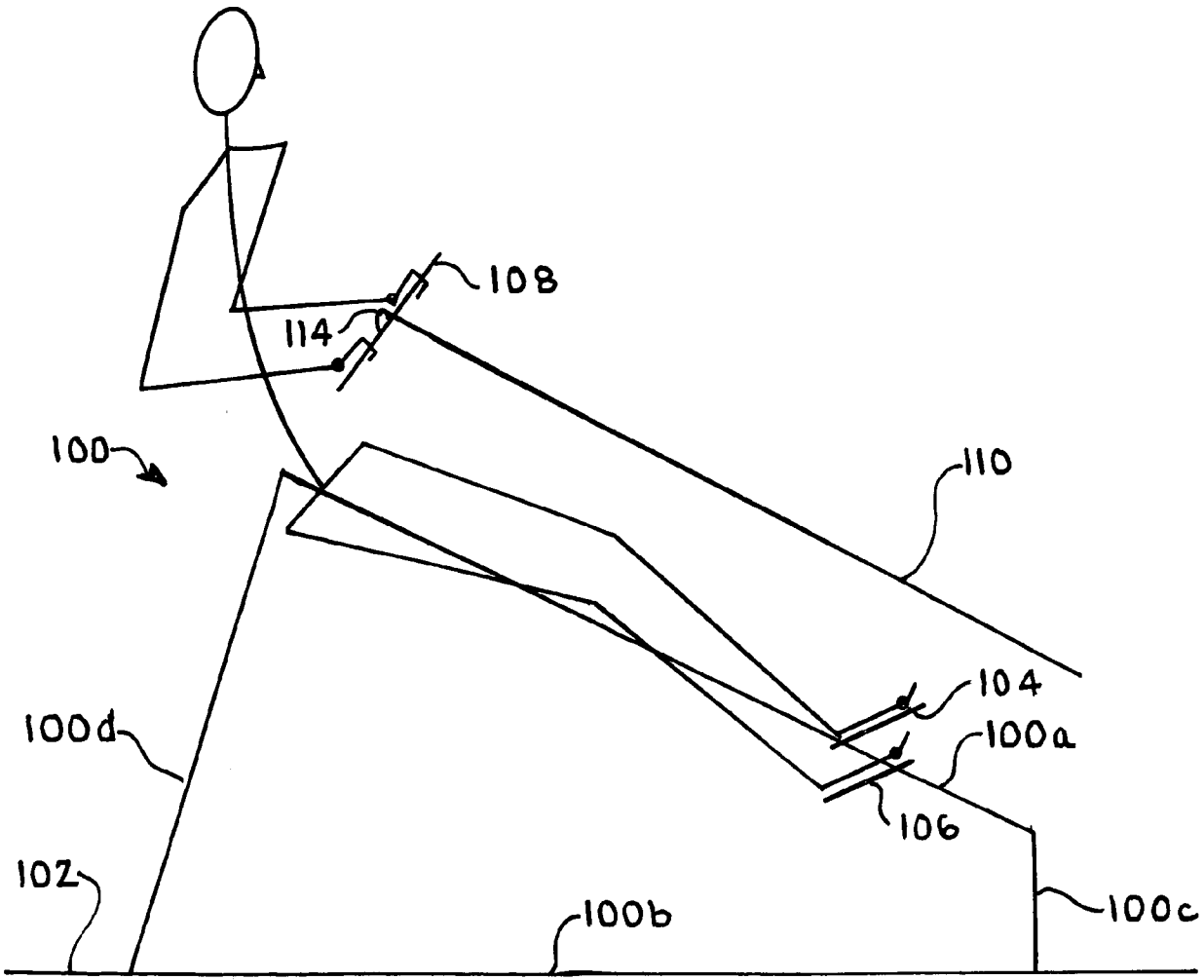
FIG. 6*j* is a schematic view of a multi-planar rowing machine in a declined position with the user at an end point for a toes-up, wrists-up, mid-pull phase of a stroke.

The user may select still another variant of the aforementioned exercise protocols by modifying the manner in which the bar 108 is held during the stroke in yet another manner. By selecting such an exercise protocol, the user 112 may better emphasize training of the hand/wrist extension. One such exercise protocol is illustrated in FIGS. 6*h* through 6*j*. As may now be seen, after grasping the bar 108, the user 112 turns their wrists upwardly about 1 to 1½ inches to place the wrists in a "wrists-up" position. By placing the wrists in this position, the cable attachment 114 is turned up about 90 degrees, thereby placing the cable attachment 114 in a second generally orthogonal relationship with the cable 110. The user 112 then initiates either a low-pull, high-pull or, as illustrated in FIGS. 6*i* and 6*j*, a mid-pull phase. As the user 112 performs a selected pull phase, the cable attachment 114 passively aligns with the cable 110 (see FIG. 6*i*) as the force of the legs and torso temporarily overwhelm the hand/wrist extensors. At the end of the pull phase, however, the combined force of the legs and torso declines and the smaller hand/wrist extensors begin to dominate, thereby enabling the user 112 to complete a dynamic hand/wrist extension movement (see FIG. 6*j*) as soon as the hand/wrist extensors become dominant.

If desired, the user 112 may further adjust the muscle groups to be trained by selecting variants of the aforementioned exercise protocols. One such variant involves a selection between the "heels-on" and "heels-off" position for the feet. The heels-on position is shown in FIG. 6*a* and, if desired, the user 112 may select an exercise protocol in which the entire stroke is performed in the heels-on position. Alternately, the user 112 may select an exercise protocol in which one or all of the strokes are performed in the heels-off position. In this exercise protocol, the user starts the stroke with the heels of their feet resting on the foot pads 104 and 106 as illustrated in FIG. 6*a*. As the user 112 extends their legs and retracts their arms into either a low, mid or high pull phase, the user 112 simultaneously lifts the heels of their feet off of the foot pads 104 and 106 as illustrated in FIGS. 6*b–d*. Subsequently, as the user retracts their legs and extends their arms in the flex phase, the user 112 simultaneously returns their heels onto the foot pads 104 and 106. The heels-off position better emphasizes training of the ankle/calf plantar flexion such that the gastrocnemius/soleus muscle of the calf predominates over the quadriceps during the pull stroke.

Another such variant of the aforementioned exercise protocols which enable the user 112 to adjust the muscle groups to be trained involves a selection between the "toes-down" position and the "toes-up" position for the feet. The toes-down position is shown in FIG. 6*h* and, if desired, the user 112 may select an exercise protocol in which the entire stroke is performed in the toes-down position. Alternately, the user 112 may select an exercise protocol in which one or all of the strokes are performed in the toes-up position. In this exercise protocol, the user starts the stroke with the toes of their feet resting on the foot pads 104 and 106 as illustrated in FIG. 6*h*. As the user 112 extends their legs and retracts their arms into either a low, mid or high pull phase, the user 112 simultaneously lifts the toes of their feet off of the foot pads 104 and 106 as illustrated in FIGS. 6*i–j*. Subsequently, as the user retracts their legs and extends their arms in the flex phase, the user 112 simultaneously returns their toes onto the foot pads 104 and 106. The toes-up position better emphasizes training of the ankle/calf dorsa flexion such that the quadriceps predominate over the muscles of the calf during the pull stroke.

Figure 6K:
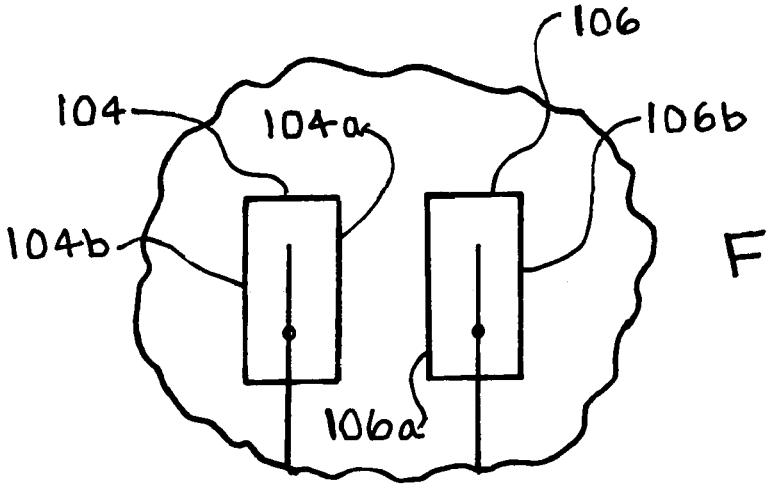
FIG. 6*k* is a partial top schematic view of a multi-planar rowing machine in a declined position with the user in a toes-straight position.
Figure 6L:
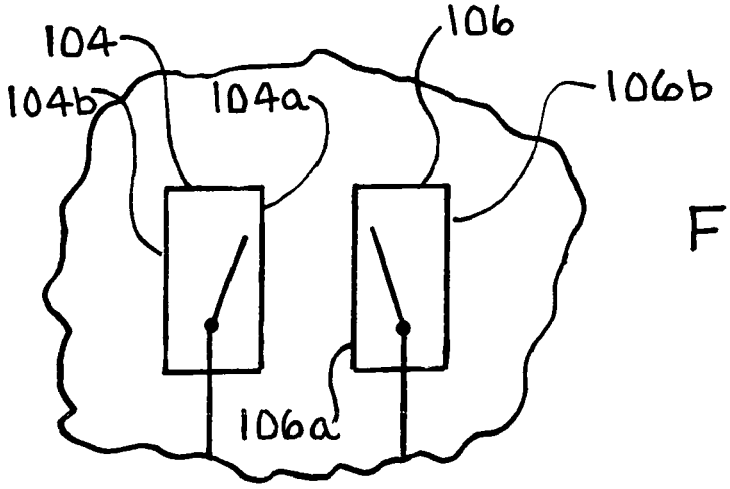
FIG. 6*l* is a partial top schematic view of a multi-planar rowing machine in a declined position with the user in a toes-in position.
Figure 6M:
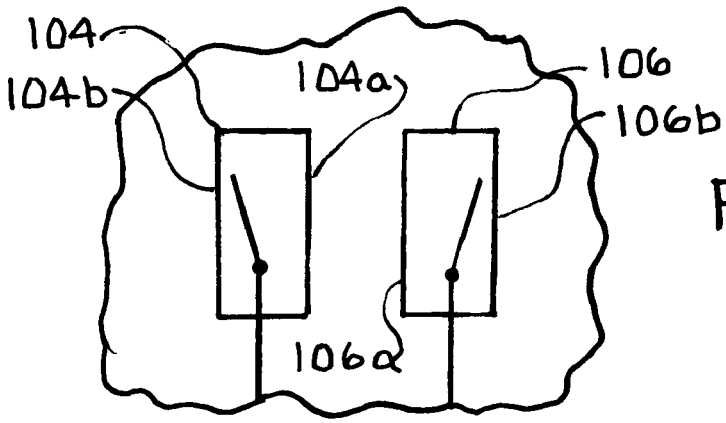
FIG. 6*m* is a partial top schematic view of a multi-planar rowing machine in a declined position with the user in a toes-out position.

Still another variant of the aforementioned exercise protocols which enable the user 112 to adjust the muscle groups to be trained involves a selection between "toes-straight", "toes-in" and "toes-out" positions for the feet. The toes-straight position is illustrated in FIG. 6*k* and is the position normally assumed by the user 112 when placing their feet on the foot pads 104 and 106. The toes-in position is illustrated in FIG. 6*l* and involves the user 112 turning their feet such that the toes point towards inner side surfaces 104*a* and 106*a* of foot pads 104 and 106. The toes-out position is illustrated in FIG. 6*m* and involves the user 112 turning their feet such that the toes point towards outer side surfaces 104*b* and 106*b* of foot pads 104 and 106. By selecting one of the toes-in or toes-out positions in combination with one of the aforementioned exercise protocols, the user 112 will affect training of the extensors.

Of course, it should be readily appreciated that the heels-on, the toes-down, and the toes-straight position are, in effect, the same position. Accordingly, in selecting a particular exercise protocol, the user 112 may only select a combination of: a) low-pull, mid-pull or high pull phases; b) wrists-even, wrists-up, or wrists down; and c) heels-on/toes-down/toes-straight, heels-on/toes-down/toes-in, heels-on/toes-down/toes-out, heels-on/toes-up/toes-straight, heels-on/toes-up/toes-in, heels-on/toes-up/toes-out, heels-off/toes-down/toes-straight, heels-off/toes-down/toes-in, heels-off/toes-down/toes-out, heels-off/toes-up/toes-straight, heels-off/toes-up/toes-in or heels-off/toes-up/toes-out positions for a stroke. Successive strokes may mirror the combination selected for the first stroke or, if desired, may be comprised of other selectable combinations.

Still other variants of the aforementioned exercise protocols suitable for use with one or more of the aforementioned combinations involve the user depressing the shoulders prior to performing a low-pull phase of a stroke, performing an isometric muscle hold for approximately two seconds between pull and flex phases of a low-pull stroke, performing an isometric muscle hold for approximately two seconds between pull and flex phases of a mid-pull stroke and performing an isometric muscle hold for approximately two seconds between pull and flex phases of a high-pull stroke. The isometric holds are used to develop chronic reflex tonus in the upper back and/or involved muscles and further to promote muscle mass gains.

Figure 7A:
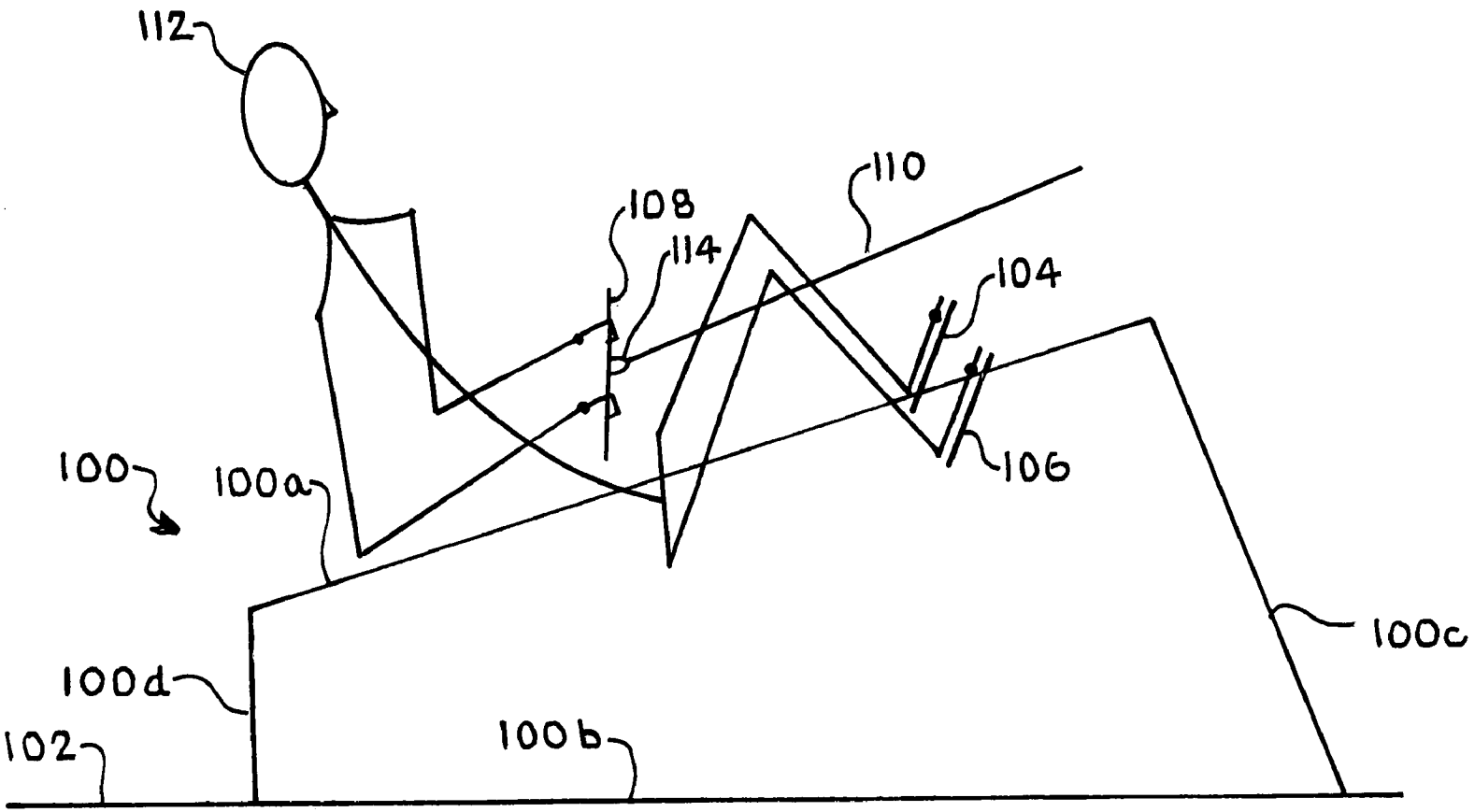
FIG. 7*a* is a schematic view of a multi-planar rowing machine in an inclined position and a user at a start point for a pull phase of a stroke.
Figure 7B:
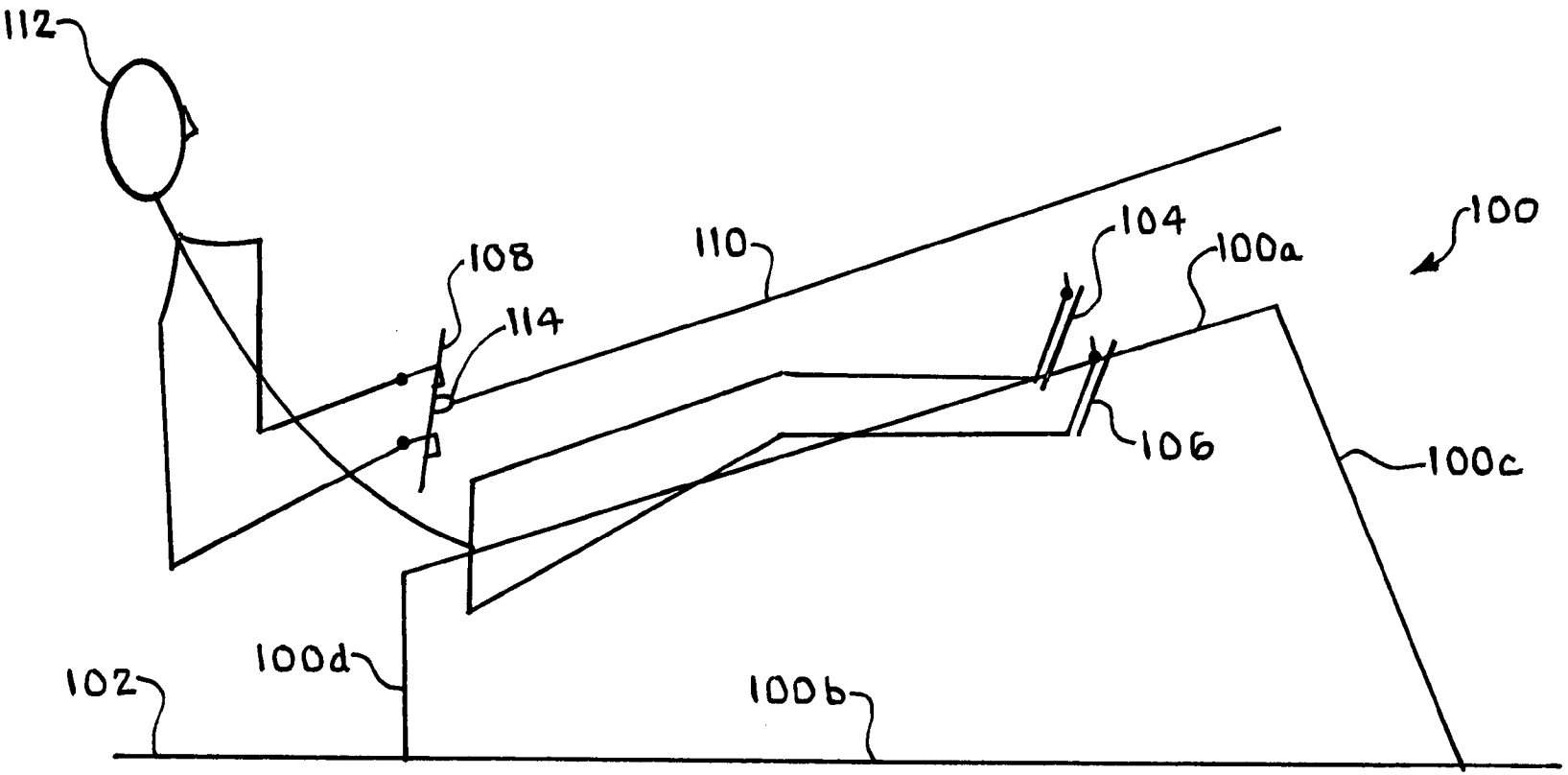
FIG. 7*b* is a schematic view of a multi-planar rowing machine in an inclined position with the user at an end point for a heels-down, wrists-even, toes-up, low-pull phase of a stroke.
Figure 7C:
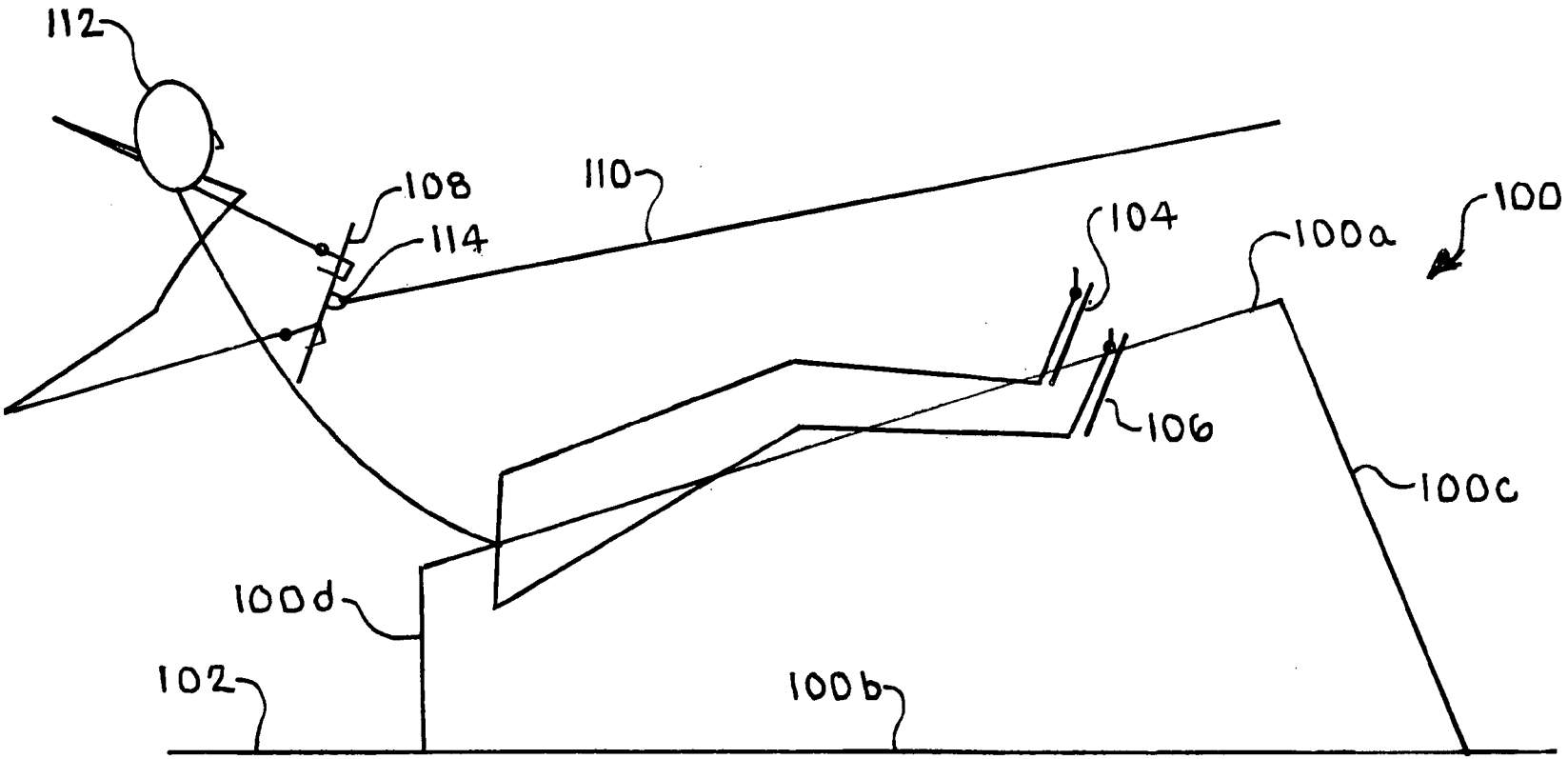
FIG. 7*c* is a schematic view of a multi-planar rowing machine in an inclined position with the user at an end point for a heels-down, wrists-even, toes-up mid-pull phase of a stroke.
Figure 7D:
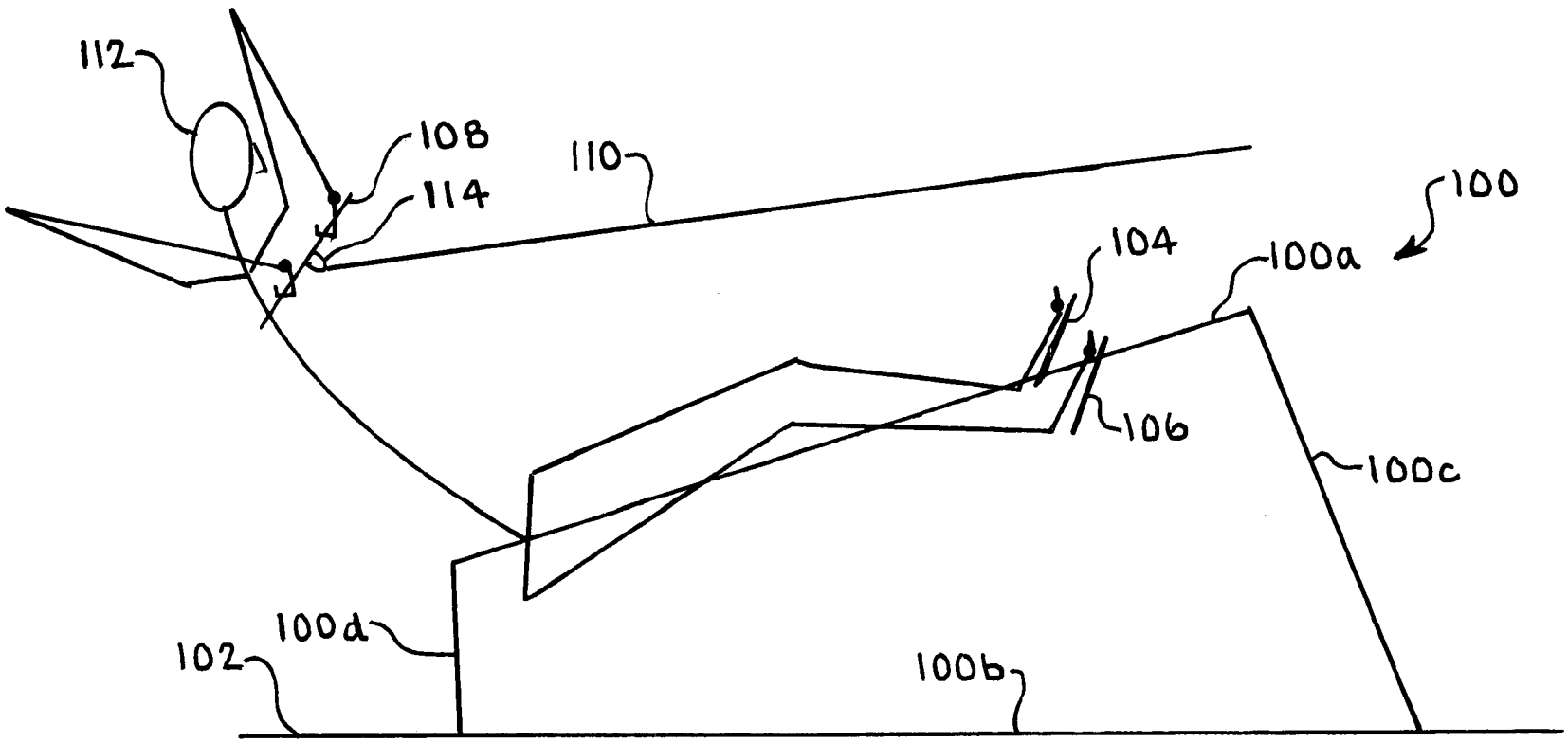
FIG. 7*d* is a schematic view of a multi-planar rowing machine in an inclined position with the user at an end point for a heels-off, wrists-even, toes-up, high-pull phase of a stroke.

Referring next to FIGS. 7*a–7e*, operation of the multi-position rowing machine 100 in the inclined position will now be described in greater detail. Once the multi-position rowing machine 100 is put in the inclined position (preferably 16 inches above the full-horizontal position if the user 112 has frequently used the multi-planar rowing machine 100 or is in good physical condition), the user 112 starts a pull phase of a stroke from the position illustrated in FIG. 7*a* and ends the pull phase of the stroke in the position illustrated in FIG. 7*b* (if the user 112 performs a low-pull phase), the position illustrated in FIG. 7*c* (if the user 112 performs a mid-pull phase) or the position illustrated in FIG. 7*c* (if the user 112 performs a high-pull phase). More specifically, FIG. 7*b* illustrates a toes-up, heels-on, wrists-even low-pull phase, FIG. 7*c* illustrates a toes-up, heels-on, wrists-even mid-pull phase, and FIG. 7*d* illustrates a toes-up, heels-off, wrists-even high-pull phase—all in an inclined stroke axis.

The major body segments trained by performing a selected exercise protocol with the multi-planar rowing machine 100 in the inclined position include the anterior tibialis of the foreleg, the hamstrings of the thigh and the abdominals of the torso. By sustaining a selected exercise protocol in the inclined position, chronic reflex tonus which effectively counters chronic postural tonus in spinal erectors is developed. Of course, in addition to the aforementioned body segments, by selecting the mid pull phase, the user 112 would add emphasis to the rhomboids and scalenius of the upper mid back and the long head of the triceps, by selecting the high pull phase, the user 112 would add emphasis to the trapezius and the levator scapulae of the neck, by selecting the heel-off position, the user 112 would add emphasis to ankle/calf plantar flexion, by selecting the wrist-down position, the user 112 would add emphasis to the hand/wrist flexion, by selecting the wrist-up position, the user 112 would add emphasis to the hand/wrist extensors, by selecting the toes-up position, the user 112 would add emphasis to the ankle/calf dorsa flexion. Finally, by selecting one of the toes-in or toes-out positions in combination with one of the aforementioned exercise protocols, the user 112 will affect training of the flexors and better emphasize the lateral hamstrings (if the toes-in position is selected) or the medial hamstrings (if the toes-out position is selected).

Figure 7E:
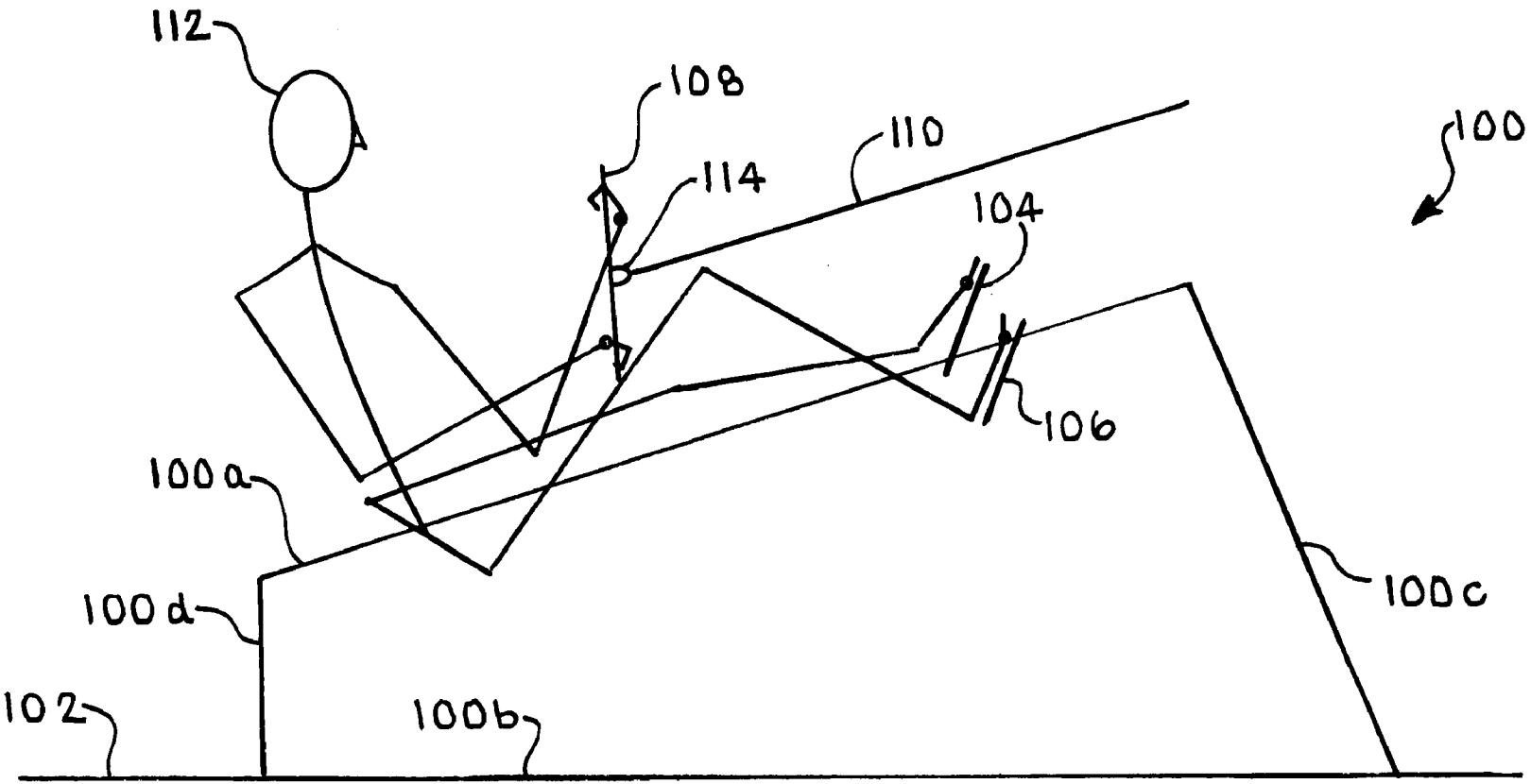
FIG. 7*e* is a schematic view of a multi-planar rowing machine in an inclined position with the user at an end point for a rotate-pull phase of a stroke.

Yet another exercise protocol which includes a rotate-pull phase may be seen by reference to FIG. 7*e*. In accordance with this protocol, during the pull phase, the user 112 rotates the bar 108 in a clockwise direction until, at the end of the pull phase, a left end of the bar 108 is generally aligned with the shoulder while a right end of the bar 108 is generally aligned with the waist. At the end of the aforementioned rotational motion, the user moves the right pelvis forward and up while moving the left pelvis rearward and down. As a result, during the rotate-pull phase of the stroke, the right leg moves into a weight bearing flexed position while the left leg remains in an unweighted extended position. The major body segments trained by performing this exercise protocol include the left abdomen and the lower lateral back. Emphasis on the right side may be obtained by performing this exercise protocol with reversed rotations of the bar 108 and the pelvis.

As before, other variants of the aforementioned exercise protocols suitable include the user 112 depressing the shoulders prior to performing a low-pull phase of a stroke, performing an isometric muscle hold for approximately two seconds between pull and flex phases of a low-pull stroke, performing an isometric muscle hold for approximately two seconds between pull and flex phases of a mid-pull stroke and performing an isometric muscle hold for approximately two seconds between pull and flex phases of a high-pull stroke.

It should be noted that, by performing a selected exercise protocol with the multi-position rowing machine 100 in the inclined position provides significant benefits to users suffering from back pain. More specifically, by firing the abdominal muscles into torso flexion—the reciprocal antagonists—. the back extensor muscles relax, thereby allowing torso flexion to occur. Thus, the higher the intensity of abdominal muscle contraction, the greater the level of back extensor muscle relation. This provides a technique to the exerciser with back pain to release muscle spasm, with attendant pain relief, in back extensor musculature.

Figure 8A:
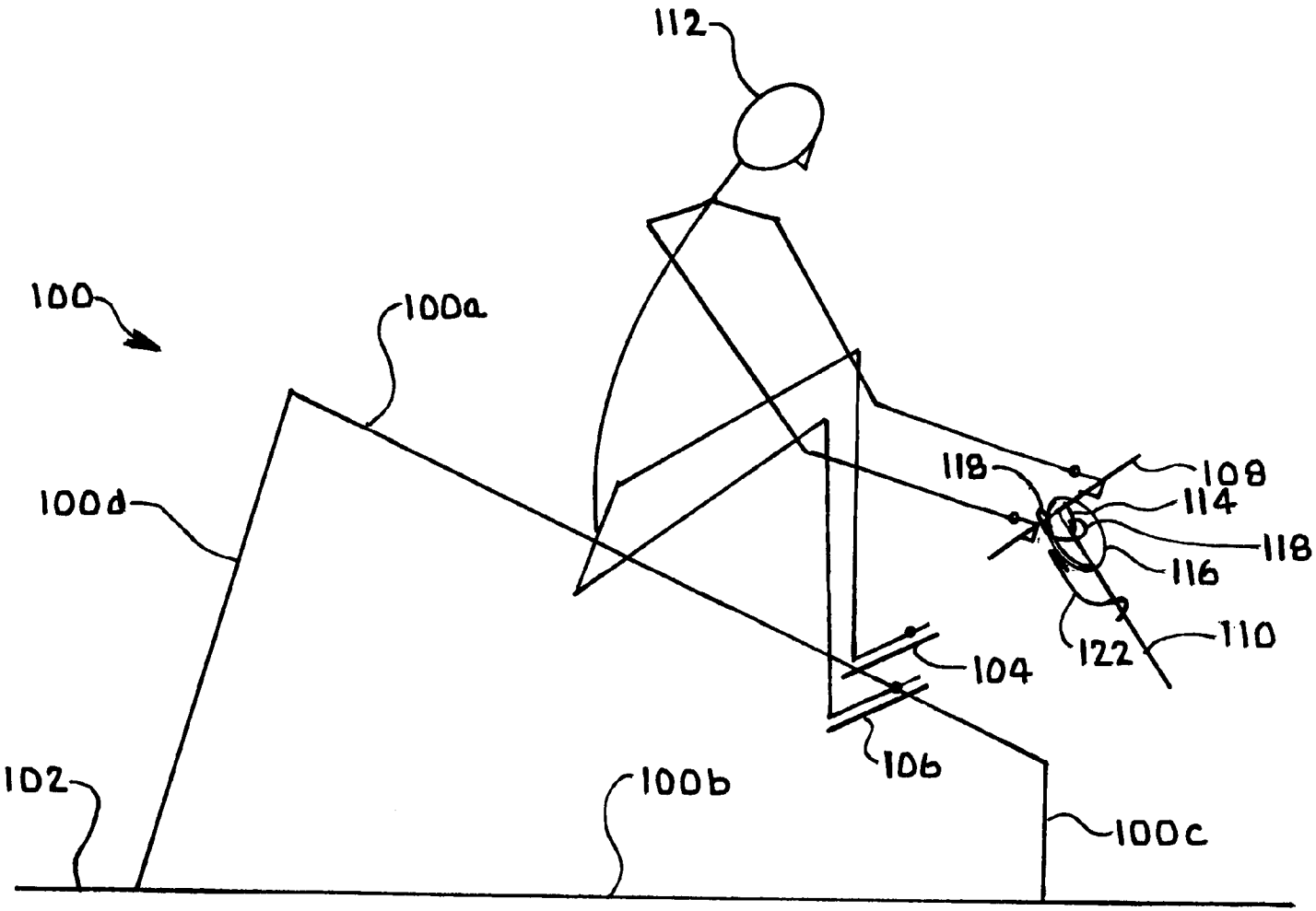
FIG. 8*a* is a schematic view of a multi-planar rowing machine in a declined position and a user at a start point of a pull phase of a stroke using a weighted bar.
Figure 8B:
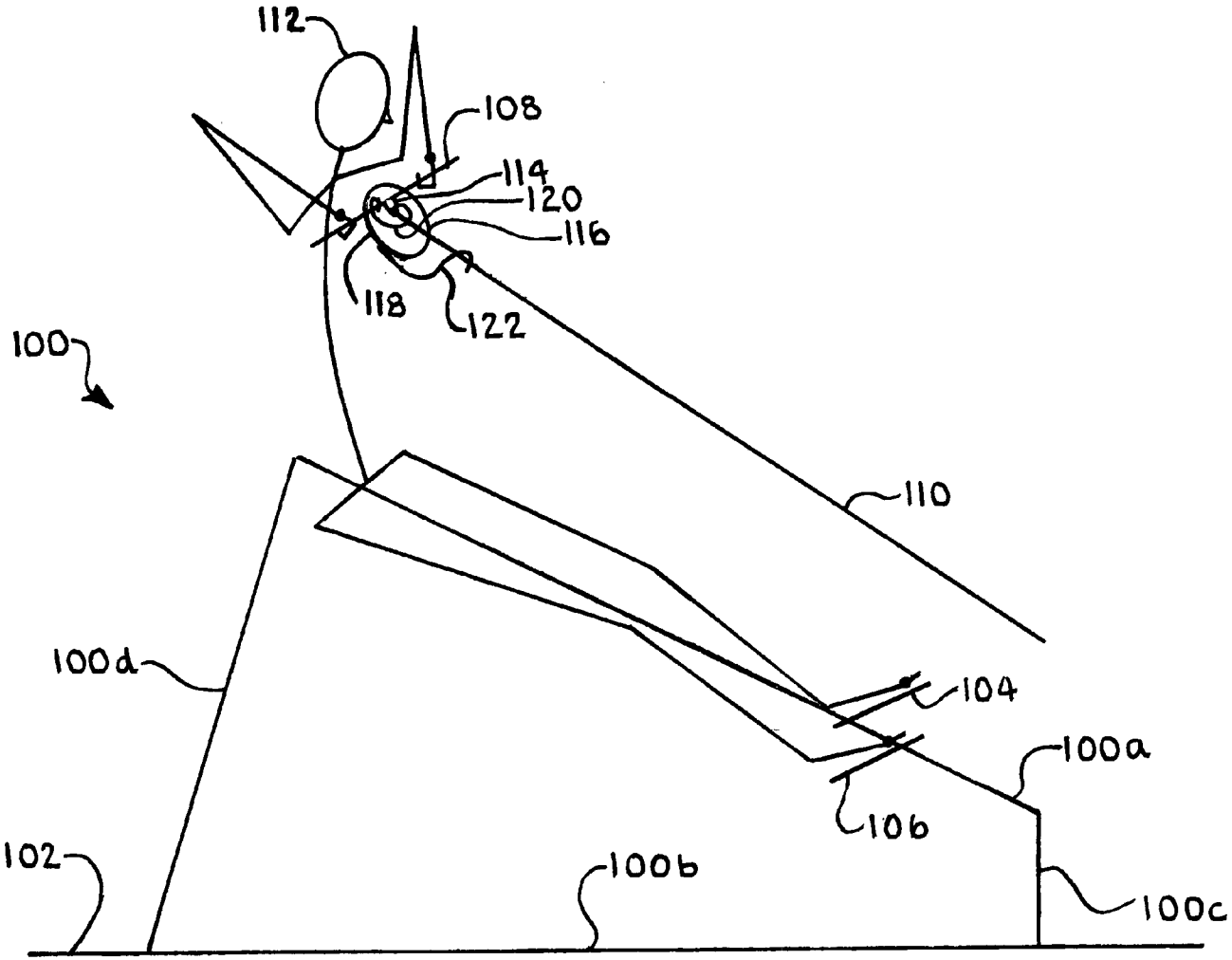
FIG. 8*b* is a schematic view of a multi-planar rowing machine with the user at an end point for a high-pull phase of a stroke using a weighted bar.
Figure 8C:
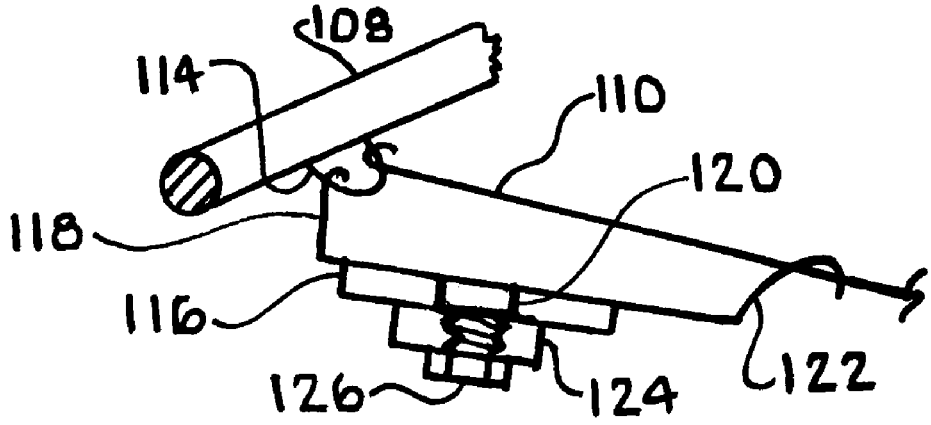
FIG. 8*c* is a partially cut-away, expanded side view of the weighted bar mechanism of FIGS. 8*a–b*.

Referring next to FIGS. 8*a* and 8*b*, an alternate embodiment of both the multi-position rowing machine 100 and additional exercise protocols suitable for use when the multi-position rowing machine is in the declined position will now be described in greater detail. In particular, FIGS. 8*a* and 8*b* show weighting at or near the handle 108. Specifically, a weight plate 116 has been added to the underside of the bar 114. A first hook member 118 couples the weight plate 116 to the bar 108 and a second hook member 122 couples the weight plate to the cable 110. It is contemplated that the weight of the weight plate 116 should preferably be adjustable between the range of two and twenty pounds. To adjust the weight of the weight plate 116, additional weight plates (not shown) may be added beneath the weight plate 116, for example, by sliding the additional weight plates onto a bolt mechanism 120 to which the weight plate 116 is secured and which projects downwardly from the general center of a lower side surface of the weight plate 116 and securing the additional weight plates to the bolt 120 using a nut mechanism. The bolt 120 is used to couple the first and second hook members 118 and 122 to the weight plate 116. One embodiment of the weighted bar mechanism may be seen by reference to FIG. 8*c*. In this embodiment, additional weight has been placed on the bar 108 by placing weight plate 124 beneath weight plate 116 and then securing the two to the bolt 120 using nut 126.

By adding the weight plate 116 to the underside of the bar 114, additional loading is provided throughout the rowing motion. This provides additional training to shoulder elevator and torso extensor body segments with emphasis on the trapezius and spinal erector muscles. While, from the illustrated start point, the user 112 may select an exercise protocol which incorporates a low-pull, a mid-pull or a high-pull phase, by selecting the high-pull phase illustrated in FIG. 8*b*, particular emphasis is directed to the trapezius muscles. Put simply, the added weight enhances the exercise stimulus experienced by the user in any of the variation of exercise protocols described herein. It is understood that other apparatus may be effectively used to secure additional weight at, or near, the handle 108.

Thus, there has been described and illustrated herein, multi-planar rowing machine exercise apparatus and exercise protocols for use in conjunction with a multi-planar rowing machine exercise apparatus selectively positioned in either inclined or declined stroke axis planes. However, those skilled in the art should recognize that numerous modifications and variations may be made in the apparatus and techniques disclosed herein without departing substantially from the spirit and scope of the invention. Accordingly, it is intended that the scope of the present invention only be limited by the terms of the claims appended hereto.

I claim:

1. A multi-planar rowing machine, comprising:

a. a rail member; and b. a support structure for supporting said rail member above a surface;

wherein said support structure further comprises:

(i) a base member; and (ii) a first platform configured for supporting a first selected portion of said multi-planar rowing machine, said first platform coupled to said base member and movable between a first position in which said first platform is generally level with said base member and said rail member is generally parallel to said surface and a second position in which said first platform is elevated relative to said base member and said rail member is in either an inclined plane or a declined plane relative to said surface.

2. The multi-planar rowing machine of claim 1 and further comprising a locking mechanism to secure said first selected portion of said multi-planar rowing machine to said first platform.

3. The multi-planar rowing machine of claim 1 and further comprising a second platform configured for supporting a second selected portion of said multi-planar rowing machine, said second platform coupled to said base member and movable between a first position in which said second platform is generally level to said base member and a second position in which said second platform is elevated relative to said base member.

4. The multi-planar rowing machine of claim 3 and further comprising a locking mechanism to secure said second selected portion of said multi-planar rowing machine to said second platform.

5. The multi-planar rowing machine of claim 3 wherein, in said respective second positions, said first platform is elevated a first distance above said base member and said second platform is elevated a second distance above said platform and wherein said second distance is approximately twice said first distance.

6. The multi-planar rowing machine of claim 3 further comprising a support lever to alternately elevate said first and second platforms such that, when said first platform is in said second position, said second platform is in said first position and, when said second platform is in said first position, said second platform is in said first position.

7. The multi-planar rowing machine of claim 3 and further comprising a support lever having first and second ends, said first platform attached to said first end of said support lever and said second platform attached to said second end of said support lever.

8. A multi-planar rowing machine according to claim 7, wherein said support lever is pivotally coupled to said base member.

9. The multi-planar rowing machine of claim 3 wherein the position of the first and second platform can be adjusted and maintained at a plurality of elevations between generally level to said base member and fully elevated relative to said base member.

10. The multi-planar rowing machine of claim 1, wherein said first selected portion of said exercise machine is a front end of said exercise machine and said rail member is in an inclined plane relative to said surface.

11. The multi-planar rowing machine of claim 1, wherein said first selected portion of said exercise machine is a rear end of said exercise machine and said rail member is in a declined plane relative to said surface.

12. The multi-planar rowing machine of claim 1, and further comprising a first platform locking mechanism for securing said first platform to said base member.

13. The multi-planar rowing machine of claim 1, and further comprising:

a first platform locking mechanism for securing said first platform to said base member; and a second platform locking mechanism for securing said second platform to said base member;

wherein said second platform locking mechanism cannot be engaged when said first platform locking mechanism is engaged; and wherein said first platform locking mechanism cannot be engaged when said second platform locking mechanism is engaged.

14. The multi-planar rowing machine of claim 1, wherein a rear end of said rail member is elevated relative to a front end of said rail member when said rail member is in said declined plane.

15. The multi-planar rowing machine of claim 1, wherein a front end of said rail member is elevated relative to a rear end of said rail member when said rail member is in said inclined plane.

16. The multi-planar rowing machine of claim 1 and further comprising a second platform configured for supporting a second selected portion of said multi-planar rowing machine, said second platform coupled to said base member and movable between a first position in which said second platform is generally level with said base member and both of said second platform and said rail member are generally parallel to said surface and a second position in which said second platform is elevated relative to said base member and said second platform and said rail member are either both inclined relative to said surface or both declined relative to said surface.

17. The multi-planar rowing machine of claim 16 and further comprising a support lever to alternately elevate said first and second platforms such that, when said first platform is in said second position, said second platform is in said first position and, when said second platform is in said first position, said second platform is in said first position.

18. The multi-planar rowing machine of claim 16 and further comprising a support lever having first and second ends, said first platform attached to said first end of said support lever and said second platform attached to said second end of said support lever.

19. A support structure for selectively elevating a first portion of an exercise machine, comprising:

a) a base member;

b) a first platform configured for supporting a first selected portion of an exercise machine, said first platform coupled to said base member and movable between a first position in which said first platform is generally level with said base member and a second position in which said first platform is elevated relative to said base member;

c) a second platform configured for supporting a second selected portion of said exercise machine, said second platform coupled to said base member and movable between a first position in which said second platform is generally level to said base member and a second position in which said second platform is elevated relative to said base member; and d) a support lever having first and second ends, said first platform attached to said first end of said support lever and said second platform attached to said second end of said support lever;

e) wherein said support lever is pivotally coupled to said base member; and f) wherein said support lever is comprised of a first portion which includes said first end and a second portion which includes said second end, said first portion of said support lever having a juncture with said second portion of said support lever which defines an obtuse angle.

20. The support structure of claim 19 wherein said angle can be adjusted.

21. A support structure for selectively elevating a first portion of an exercise machine above a surface, comprising:

a) a base member; and b) a first platform configured for supporting a first selected portion of an exercise machine having a rail member, said first platform coupled to said base member and movable between a first position in which said first platform is generally level with said base member and said rail member is generally parallel to said surface and a second position in which said first platform is elevated relative to said base member and said rail member is in either an inclined plane or a declined plane relative to said surface;

c) a second platform configured for supporting a second selected portion of said exercise machine, said second platform coupled to said base member and movable between a first position in which said second platform is generally level to said base member and a second position in which said second platform is elevated relative to said base member; and d) a support lever for coupling said first platform and said second platform to said base member;

said support lever having a first portion which includes a first end to which said first platform is attached and a second portion which includes a second end to which said second platform is attached, said first portion of said support lever having a juncture, with said second portion of said support lever, which defines an obtuse angle.

22. The support structure of claim 21, wherein said obtuse angle is a general 135 degree angle.

23. The support structure of claim 21, wherein said obtuse angle can be adjusted.

24. A support structure for selectively elevating a portion of an exercise machine above a surface, comprising:

a) a support lever;

b) a first platform configured for supporting a first selected portion of an exercise machine above said surface, said first platform coupled to said support lever and movable between a first position in which said first platform is generally level with said surface and a second position in which said first platform is elevated relative to said surface; and c) a second platform configured for supporting a second selected portion of said exercise machine above said surface, said second platform coupled to said support lever and movable between a first position in which said second platform is generally level with said surface and a second position in which said second platform is elevated relative to said surface;

d) said support lever having a first portion to which said first platform is coupled and a second portion to which said second platform is coupled; and e) said first portion of said support lever having a juncture, with said second portion of said support lever, which defines an obtuse angle.

25. The support structure of claim 24, wherein:

said second platform must be in said first, generally level, position whenever said first platform is in said second, elevated, position; and said second platform must be in said second, elevated, position whenever said first platform is in said first, generally level, position.

26. The support structure of claim 24, wherein the ratio of the length of said first portion of said support lever to the length of said second portion of said support lever is about 2:1.

* * * * *